US008431315B2

(12) United States Patent
Mutoh et al.

(10) Patent No.: US 8,431,315 B2
(45) Date of Patent: Apr. 30, 2013

(54) CAPSULE TONER, METHOD OF MANUFACTURING THE SAME, AND TWO-COMPONENT DEVELOPER

(75) Inventors: Yoshinori Mutoh, Osaka (JP); Yoshiaki Akazawa, Osaka (JP); Yoshitaka Kawase, Osaka (JP); Yoritaka Tsubaki, Osaka (JP); Keiichi Kikawa, Osaka (JP); Takashi Hara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

(21) Appl. No.: 12/878,415

(22) Filed: Sep. 9, 2010

(65) Prior Publication Data

US 2011/0059394 A1 Mar. 10, 2011

(30) Foreign Application Priority Data

Sep. 9, 2009 (JP) ..... P2009-208713
Jul. 9, 2010 (JP) ..... P2010-157330

(51) Int. Cl.
*G03G 5/00* (2006.01)

(52) U.S. Cl.
USPC ..... 430/137.11; 430/137.1

(58) Field of Classification Search ..... 430/137.1, 430/137.11
See application file for complete search history.

(56) References Cited

U.S. PATENT DOCUMENTS

| | | | | |
|---|---|---|---|---|
| 7,179,576 | B2 | 2/2007 | Ueda et al. | |
| 7,247,413 | B2 | 7/2007 | Kido et al. | |
| 2005/0058927 | A1 | 3/2005 | Mikuriya et al. | |
| 2005/0136354 | A1 | 6/2005 | Ueda et al. | |
| 2009/0297224 | A1 * | 12/2009 | Kawase et al. | 399/252 |

FOREIGN PATENT DOCUMENTS

| | | |
|---|---|---|
| JP | 1-185665 | 7/1989 |
| JP | 04-182661 | 6/1992 |
| JP | 05-173357 | 7/1993 |
| JP | 06-342224 | 12/1994 |
| JP | 2005-091706 | 4/2005 |
| JP | 2005-099081 | 4/2005 |
| JP | 2005-181539 | 7/2005 |
| JP | 2007-017962 | 1/2007 |
| JP | 2008-145635 | 6/2008 |
| JP | 2009-014757 | 1/2009 |
| JP | 2009-025669 | 2/2009 |
| JP | 2009-192957 | 8/2009 |

* cited by examiner

*Primary Examiner* — Stewart Fraser
(74) *Attorney, Agent, or Firm* — Nixon & Vanderhye P.C.

(57) ABSTRACT

There are provided a capsule toner, a two-component developer, and a capsule toner manufacturing method. The capsule toner in which a resin coating layer made of fine release-agent particles and fine resin particles is made on the surfaces of toner base particles, and thus excellent offset resistance without impairing blocking resistance can be obtained. The capsule toner includes toner base particles containing a binder resin and a colorant, and a resin coating layer made of fine release-agent particles and fine resin particles, for covering the surfaces of the toner base particles. The fine release-agent particles are dispersed in the resin coating layer.

10 Claims, 6 Drawing Sheets

CAPSULE TONER, METHOD OF MANUFACTURING THE SAME, AND TWO-COMPONENT DEVELOPER

CROSS-REFERENCE TO RELATED APPLICATION

This application claims priority to Japanese Patent Application No. 2009-208713, which was filed on Sep. 9, 2009, and No. 2010-157330, which was filed on Jul. 9, 2010, the contents of which are incorporated herein by reference in their entirety.

BACKGROUND OF THE INVENTION

1. Field of the Invention

The present invention relates to a capsule toner, a method of manufacturing the capsule toner, and a two-component developer.

2. Description of the Related Art

An image forming apparatus for forming images by means of electrophotography comprises a photoreceptor, a charging section, an exposure section, a developing section, a transfer section, a fixing section, and a cleaning section.

The charging section electrically charges the surface of the photoreceptor. The exposure section applies signal light to the surface of the photoreceptor in a charged state to form an electrostatic latent image corresponding to image information. The developing section supplies toner contained in a developer to the electrostatic latent image formed on the surface of the photoreceptor to form a toner image. The transfer section transfers the toner image formed on the surface of the photoreceptor onto a recording medium. Moreover, the fixing section fixes the transferred toner image to the recording medium. Further, the cleaning section is constructed for example of a cleaning blade, and scrapes off residual toner remaining on the surface of the photoreceptor after toner image transfer by a blade to clean the surface of the photoreceptor.

Such an image forming apparatus effects image formation by developing an electrostatic latent image with use of, as a developer, a one-component developer containing toner or a two-component developer containing toner and carrier. The toner used therein takes the form of resin particles obtained by dispersing a colorant and a wax or the like acting as a release agent in a polyester-based binder resin which is a matrix, followed by performing granulation.

A kneading-pulverization method has been widely used to date as a toner manufacturing method. However, a pulverized toner consists of particles of irregular shape with many surface asperities, and the surfaces thereof in a pulverized state become toner particle surfaces without being treated, with consequent likelihood of lack of uniformity in surface composition. This makes it difficult to render the surface conditions of toner particles uniform. When toner particle surfaces are irregular-shaped and bears many asperities, then toner flowability is deteriorated, or fogging, toner scattering, or the like problem occurs due to lack of uniformity in toner composition.

In light of such a problem resulting from irregularity in shape of toner particle surfaces, instead of the kneading-pulverization method, there have been proposed various wet techniques whereby a toner is manufactured by mixing fluid dispersions of toner raw materials, followed by causing aggregation. However, in the case of the wet technique, a dispersion stabilizer and an aggregating agent are heavily used, wherefore part of such a component remains on the surfaces or in the interior of toner particles, with consequent deterioration in resistance to moisture and in charging characteristics. As a notable drawback, charging characteristics are likely to become unstable significantly.

Meanwhile, in keeping with the recent trend toward even higher image quality, toner has come to be designed to have an increasingly smaller particle size. This creates the tendency of an increase in the proportion of a toner with small particle size in fine powder form contained in a two-component developer. In a two-component developer containing a toner with small particle size, due to cracking or changes in shape in the toner with small particle size resulting from a stress caused within a developing device, there arise a toner-spent phenomenon on a carrier (contamination of a charge-applying member) and ensuing deterioration in charging properties of a developer. This adversely affects the processes of development and transfer, thus causing image quality degradation.

Hence, as a toner characterized by having excellent flowability, transfer properties, and so forth, being uniform in respect of charging performance, having high offset resistance, and in addition offering various advantageous capabilities, a capsule toner is proposed that is formed by applying a resin-layer coating to the surfaces of toner base particles.

However, in the capsule toner with a resin-layer coating, in general, fine resin particles whose heat resistance is higher than that of toner base particles is used to achieve blocking resistance improvement. In this case, the toner base particles cannot be melted readily, with consequent likelihood of occurrence of a low-temperature offset phenomenon. Furthermore, since the resin coating layer hinders a release agent from oozing from the interior of the toner base particles, a high-temperature offset phenomenon is likely to occur, wherefore a sufficiently wide range of temperatures enabling fixation (non-offset temperature range) cannot be attained.

In Japanese Unexamined Patent Publication JP-A 6-342224 (1994), there is disclosed toner particles composed of base particles and fine resin particles that adhered firmly thereto by means of mechanical impact force. In addition, in Japanese Unexamined Patent Publication JP-A 5-173357 (1993), there is disclosed a toner with a wax that adhered firmly to toner surface.

However, in the toner disclosed in JP-A 6-342224, a release agent is contained in the base particles. Therefore, the release agent is unable to exude readily to the surfaces of toner particles during a fixing process, with consequent difficulty of attaining adequate offset resistance. Furthermore, in the toner disclosed in JP-A 5-173357, the toner surface is coated with a wax, wherefore the blocking resistance is poor.

SUMMARY OF THE INVENTION

An object of the invention is to provide a capsule toner, a two-component developer, and a method of manufacturing the capsule toner in which a resin coating layer made of fine release-agent particles and fine resin particles is made on the surfaces of toner base particles, and thus excellent offset resistance without impairing blocking resistance can be obtained.

The invention provides a capsule toner comprising:

toner base particles containing a binder resin and a colorant; and a resin coating layer made of fine release-agent particles and fine resin particles, for covering surfaces of the toner base particles, the fine release-agent particles being dispersed in the resin coating layer.

According to the invention, in the capsule toner having a resin coating layer, the resin coating layer contains fine release-agent particles. In this case, in contrast to the case where a release agent is contained in toner base particles only, the fine release-agent particles are able to exude readily to the surfaces of toner particle. This makes it possible to prevent occurrence of a high-temperature offset phenomenon and thereby obtain a toner which can be fixed over a wide fixable temperature range. Moreover, since the fine release-agent particles are dispersed in the resin coating layer, in contrast to the case where the surfaces of toner base particles are coated with a release agent, satisfactory blocking resistance can be attained.

Moreover, in the invention, it is preferable that the fine release-agent particles in the resin coating layer are contained in a range of 0.2 part by weight or more and 2.3 parts by weight or less based on 100 parts by weight of the toner base particles.

According to the invention, the fine release-agent particles in the resin coating layer are contained in a range of 0.2 part by weight or more and 2.3 parts by weight or less based on 100 parts by weight of the toner base particles. Accordingly, the fine release-agent particles can be adequately dispersed in the resin coating layer, wherefore satisfactory blocking resistance can be attained.

The invention provides a two-component developer containing the capsule toner mentioned above and a carrier.

According to the invention, the two-component developer contains the capsule toner of the invention and a carrier, and is therefore capable of offering both blocking resistance and hot-offset resistance at the same time.

The invention provides a method of manufacturing a capsule toner comprising:

a step of causing toner base particles and a fine particle mixture made of fine resin particles and fine release-agent particles to flow so that the fine particle mixture adheres to surfaces of the toner base particles, thereby forming coated toner particles; and a step of spraying the coated toner particles with a liquid for plasticizing the toner base particles and the fine particle mixture while causing the coated toner particles in the presence of carrier gas to flow so that the fine particle mixture is turned into a film under an impact force, thereby forming a resin coating layer on the surfaces of the toner base particles.

According to the invention, since the toner base particles and the fine particle mixture made of fine resin particles and fine release-agent particles in a fluidized state are sprayed with the liquid for plasticizing those particles, it follows that the particles are plasticized and softened. This makes it possible to form, on the surfaces of the toner base particles, a resin coating layer in which the fine release-agent particles can be dispersed under a small impact force.

Moreover, in the invention, it is preferable that the fine particle mixture is produced by a method comprising:

a first step of preparing a fine particle mixture aqueous dispersion by mixing an aqueous dispersion containing fine resin particles and an aqueous dispersion containing fine release-agent particles; and a second step of obtaining the fine particle mixture by dehydrating and drying the fine particle mixture aqueous dispersion.

According to the invention, the fine particle mixture is produced by the method comprising the first step of preparing a fine particle mixture aqueous dispersion by mixing an aqueous dispersion containing fine resin particles and an aqueous dispersion containing fine release-agent particles and the second step of obtaining the fine particle mixture by dehydrating and drying the fine particle mixture aqueous dispersion. In this way, there is obtained a fine particle mixture in which the fine resin particles and the fine release-agent particles are evenly mixed together. Accordingly, the release agent can be adequately dispersed in the resin coating layer, wherefore both blocking resistance and hot-offset resistance of the toner can be achieved at the same time.

Moreover, in the invention, it is preferable that the aqueous dispersion containing fine resin particles is obtained by subjecting a resin to emulsion polymerization or by emulsifiably dispersing a resin in an aqueous medium.

According to the invention, the aqueous dispersion containing fine resin particles is obtained by subjecting a resin to emulsion polymerization or by emulsifiably dispersing a resin in an aqueous medium. That is, it is possible to obtain an aqueous dispersion containing fine resin particles having a fine and uniform particle size. Accordingly, the release agent can be adequately dispersed in the resin coating layer, wherefore both blocking resistance and hot-offset resistance of the toner can be achieved at the same time.

Moreover, in the invention, it is preferable that the aqueous dispersion containing fine release-agent particles is obtained by emulsifiably dispersing a release agent in an aqueous medium or by substituting an aqueous medium for the release agent emulsifiably dispersed in a solvent.

According to the invention, the aqueous dispersion containing fine release-agent particles is obtained by emulsifiably dispersing a release agent in an aqueous medium or by substituting an aqueous medium for the release agent emulsifiably dispersed in a solvent. That is, it is possible to obtain an aqueous dispersion containing fine release-agent particles having a fine and uniform particle size. Accordingly, the release agent can be adequately dispersed in the resin coating layer, wherefore both blocking resistance and hot-offset resistance of the toner can be achieved at the same time.

Moreover, in the invention, it is preferable that, in the first step, the fine particle mixture aqueous dispersion is prepared such that a ratio of the fine release-agent particles to the fine resin particles in terms of weight falls in a range of 3% by weight or more and 30% by weight or less. According to the invention, in the first step, the fine particle mixture aqueous dispersion is prepared such that the ratio of the fine release-agent particles to the fine resin particles in terms of weight falls in the range of 3% by weight or more and 30% by weight or less. Accordingly, the release agent can be adequately dispersed in the resin coating layer, wherefore both blocking resistance and hot-offset resistance of the toner can be achieved at the same time.

Moreover, in the invention, it is preferable that, in the fine particle mixture, a ratio in average particle size of the fine release-agent particles to the fine resin particles falls in a range of 0.3 or more and 2.0 or less.

According to the invention, in the fine particle mixture, the ratio in average particle size of the fine release-agent particles to the fine resin particles falls in the range of 0.3 or more and 2.0 or less. Accordingly, the fine release-agent particles can be adequately dispersed in the resin coating layer and can also be exposed at the surface of the resin coating layer. As a result, both blocking resistance and hot-offset resistance of the toner can be achieved at the same time.

Moreover, in the invention, it is preferable that an onset temperature of the fine release-agent particles based on differential scanning calorimetry is higher than or equal to 70° C.

According to the invention, the onset temperature of the fine release-agent particles based on differential scanning calorimetry is higher than or equal to 70° C. This makes it possible to prevent the fine release-agent particles from being fused to spread over the surface of the capsule toner in a film-like form, and thereby form a resin coating layer in which the fine release-agent particles are finely dispersed. As a result, both blocking resistance and hot-offset resistance of the toner can be achieved at the same time.

Moreover, in the invention, it is preferable that, in the second step, the dehydrating and drying operation is carried out by a heated-air direct drying process.

According to the invention, in the second step, the dehydrating and drying operation is carried out by the heated-air direct drying process. Accordingly, the fine particles constituting the resin coating layer can be dried with efficiency.

Moreover, in the invention, it is preferable that a volume average particle size of the fine release-agent particles falls in a range of 0.1 μm or more and 1.0 μm or less.

According to the invention, the volume average particle size of the fine release-agent particles falls in the range of 0.1 μm or more and 1.0 μm or less. Accordingly, the fine release-agent particles can be dispersed evenly in the resin coating layer without being aggregated to form secondary particles on the toner surface or liberating from the toner surface.

Moreover, the invention provides a method of manufacturing a capsule toner comprising:

a step of causing toner base particles and fine release-agent particles to flow so that the fine release-agent particles adhere to surfaces of the toner base particles;

a step of causing the toner base particles to which the fine release-agent particles have adhered and fine resin particles to flow so that the fine resin particles adhere to the surfaces of the toner base particles;

a step of spraying the toner base particles to which the fine release-agent particles have adhered and the fine resin particles which are in a fluidized state, with a liquid having an effect of plasticizing those particles; and a step of turning the fine resin particles and the fine release-agent particles into a film under an impact force, thereby forming a resin coating layer on the surfaces of the toner base particles.

According to the invention, since the toner base particles to which the fine release-agent particles have adhered and the fine resin particles which are in a fluidized state are sprayed with the liquid for plasticizing those particles, it follows that the particles are plasticized and softened. This makes it possible to form, on the surfaces of the toner base particles, a resin coating layer in which the fine release-agent particles can be dispersed under a small impact force.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1A:
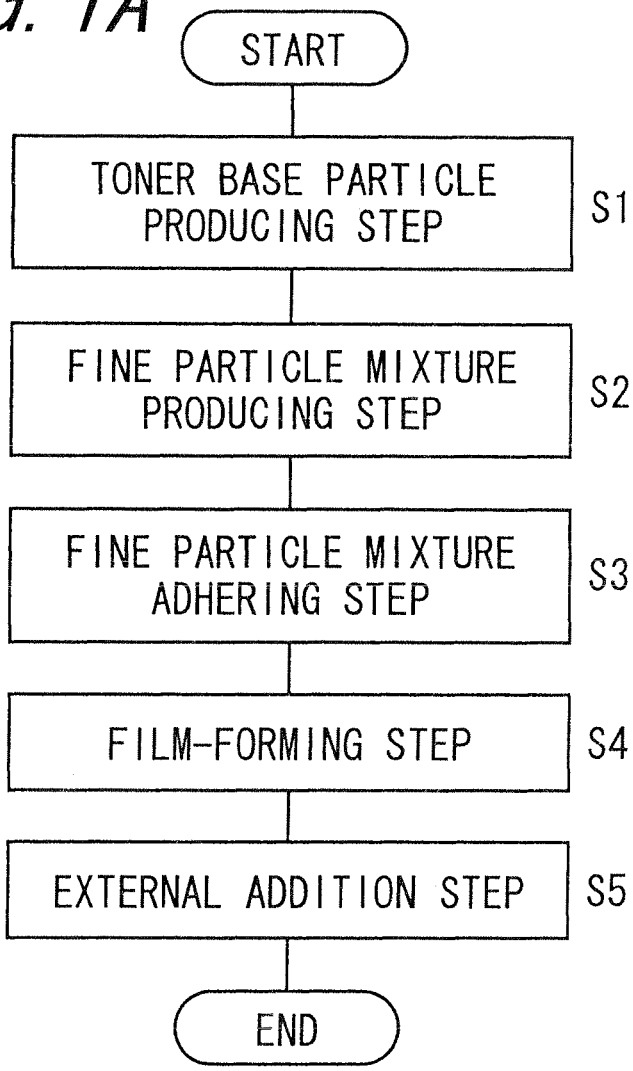
FIG. 1A is a flowchart showing a first procedure of a method of manufacturing a capsule toner in accordance with one embodiment of the invention.

Now referring to the drawings, preferred embodiments of the invention will be described in detail.

A toner embodying the invention is a capsule toner composed of toner base particles and a resin coating layer for covering the surfaces of the toner base particles. The resin coating layer includes fine resin particles and fine release-agent particles. And thus, the resin coating layer in which the fine release-agent particles are contained is made on the surfaces of the toner base particles.

1. Toner Manufacturing Method

FIG. 1A is a flowchart showing a first procedure of a method of manufacturing a capsule toner in accordance with one embodiment of the invention. The method of manufacturing the capsule toner of this embodiment includes a toner base particle producing step S1, a fine particle mixture producing step S2, a fine particle mixture adhering step S3, a film-forming step S4, and an external addition step S5.

(1) Toner Base Particle Producing Step S1

In the toner base particle producing step S1, there are formed toner base particles to be covered with a resin coating layer made of fine resin particles and fine release-agent particles. The toner base particles are particles containing a binder resin and a colorant. There is no particular limitation to how the toner base particles are to be produced, wherefore the production can be carried out by a known method. Examples of methods for producing the toner base particles include a dry technique such as a crushing method and a wet technique such as a suspension polymerization method, an emulsification aggregation method, a dispersion polymerization method, a dissolution suspension method, and a melting emulsification method. Now, a description will be given below as to production of the toner base particles based on the crushing method.

(Production of Toner Base Particles by a Pulverization Method)

In producing toner base particles by a pulverization method, a toner composition containing binder resin, a colorant and other additive is dry-mixed by a mixer, and thereafter melt-kneaded by a kneading machine. A kneaded material obtained by the melt-kneading is cooled and solidified, and then a solidified material is pulverized by a pulverizing machine. Subsequently, a resultant material is treated with particle size adjustment such as classification according to need. The toner base particles are thus obtained.

Usable mixers include heretofore known mixers including, for example, a Henschel-type mixing apparatus such as HENSCHEL MIXER (trade name, manufactured by Mitsui Mining Co., Ltd.), SUPERMIXER (trade name, manufactured by Kawata MEG Co., Ltd.), and MECHANOMILL (trade name, manufactured by Okada Seiko Co., Ltd.), ANGMILL (trade name, manufactured by Hosokawa Micron Corporation), HYBRIDIZATION SYSTEM (trade name, manufactured by Nara Machinery Co., Ltd.), and COSMOSYSTEM (trade name, manufactured by Kawasaki Heavy Industries, Ltd.)

Usable kneaders also include heretofore known kneaders including, for example, a commonly-used kneader such as a twin-screw extruder, a three roll mill, and a laboplast mill. Specific examples of such kneaders, for example, include a single or twin screw extruder such as TEM-100B (trade name, manufactured by Toshiba Machine Co., Ltd.), PCM-65/87 and PCM-30 (both of which are trade names and manufactured by Ikegai, Ltd.), and open roll-type kneading machines such as KNEADEX (trade name, manufactured by Mitsui Mining Co., Ltd.) Among them, the open roll-type kneading machine is preferable.

Examples of the pulverizing machine, for example, include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner base particles by classification with a centrifugal force and a wind force is usable, and an example thereof includes a revolving type wind-force classifying machine (rotary type wind-force classifying machine).

(Raw Material of Toner Base Particle)

As described above, the toner base particle contains a binder resin and a colorant.

As the binder resin, amorphous polyester is used. An amorphous polyester resin is a resin having no definite melting point. Since an amorphous resin is usually high in resistance, even if it is exposed at toner surfaces, its impact on stability in charging properties can be minimized. In addition, a crystalline polyester resin may be used.

Commonly-used amorphous polyester is obtained through condensation polymerization using, as constituent monomers, one or more substances selected from among divalent alcohol monomers and trivalent or higher-valent polyalcohol monomers and one or more substances selected from among divalent carboxylic acid monomers and trivalent or higher-valent polycarboxylic acid monomers.

Examples of divalent alcohol monomers include: alkylene oxide adducts of bisphenol A such as polyoxypropylene (2.2)-2,2-bis(4-hydroxyphenyl) propane, polyoxypropylene (3.3)-2,2-bis(4-hydroxyphenyl)propane, polyoxypropylene (2.0)-2,2-bis(4-hydroxyphenyl)propane, polyoxypropylene (2.0)-polyoxyethylene (2.0)-2,2-bis(4-hydroxyphenyl)propane, and polyoxypropylene (6)-2,2-bis (4-hydroxyphenyl) propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexane dimethanol; dipropylene glycol; polyethylene glycol; polypropylene glycol; polytetramethylene glycol; bisphenol A; a propylene adduct of bisphenol A; an ethylene adduct of bisphenol A; and hydrogenated bisphenol A.

Examples of trivalent or higher-valent polyalcohol monomers include: sorbitol; 1,2,3,6-hexanetetrol; 1,4-sorbitan; pentaerythritol; dipentaerythritol; tripentaerythritol; 1,2,4-butanetriol; 1,2,5-pentanetriol; glycerol; 2-methylpropanetriol; 2-methyl-1,2,4-butanetriol; trimethylolethane; trimethylolpropane; and 1,3,5-trihydroxymethylbenzene.

In the invention, either one or a plurality of divalent alcohol monomers and trivalent or higher-valent polyalcohol monomers can be used.

Where acid components are concerned, examples of divalent carboxylic acid monomers include: a maleic acid; a fumaric acid; a citraconic acid; an itaconic acid; a glutaconic acid; a phthalic acid; an isophthalic acid; a terephthalic acid; a succinic acid; an adipic acid; a sebacic acid; an azelaic acid; a malonic acid; a n-dodecenyl succinic acid; a n-dodecyl succinic acid; a n-octyl succinic acid; an isooctenyl succinic acid; an isooctyl succinic acid; and anhydrides of such acids or lower alkyl esters thereof.

Examples of trivalent or higher-valent polycarboxylic acid monomers include: a 1,2,4-benzene tricarboxylic acid; a 2,5,7-naphthalene tricarboxylic acid; a 1,2,4-napthalene tricarboxylic acid; a 1,2,4-butane tricarboxylic acid; a 1,2,5-hexane tricarboxylic acid; 1,3-dicarboxyl-2-methyl-2-methylene carboxy propane; a 1,2,4-cyclohexane tricarboxylic acid; tetra (methylecarboxyl)methane; a 1,2,7,8-octane tetracarboxylic acid; a pyromellitic acid; EMPOL trimer acid; and anhydrides of such acids and lower alkyl esters thereof.

In the invention, either one or a plurality of divalent carboxylic acid monomers and trivalent or higher-valent polycarboxylic acid monomers can be used.

In the invention, there is no particular limitation to how the amorphous polyester is to be produced, and it can be produced through esterification or in a transesterification reaction.

As the colorant, it is possible to use an organic dye, an organic pigment, an inorganic dye, an inorganic pigment or the like which is customarily used in the electrophotographic field.

Examples of black colorant include: carbon black, copper oxide, manganese dioxide, aniline black, activated carbon, non-magnetic ferrite, magnetic ferrite, and magnetite.

Examples of yellow colorant include: chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NOG, tartrazine lake, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, and C.I. Pigment Yellow 138.

Examples of orange colorant include: red chrome yellow, molybdenum orange, permanent orange GTR, pyrazolone orange, vulcan orange, indanthrene brilliant orange RK, benzidine orange G, indanthrene brilliant orange GK, C.I. Pigment Orange 31, and C.I. Pigment Orange 43.

Examples of red colorant include: red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, And C.I. Pigment Red 222.

Examples of purple colorant include: manganese purple, fast violet B, and methyl violet lake.

Examples of blue colorant include: Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. Pigment Blue 15, C.I. Pigment Blue 15:2, C.I. Pigment Blue 15:3, C.I. Pigment Blue 16, And C.I. Pigment Blue 60.

Examples of green colorant include: chromium green, chromium oxide, pigment green B, malachite green lake, final yellow green G, and C.I. Pigment Green 7.

Examples of white colorant include: a compound such as zinc white, titanium oxide, antimony white, and zinc sulfide.

The colorants may be used each alone, or two or more of them with different colors may be used in combination. Further, two or more of them with the same color may be used in combination. A usage of the colorant is not limited to a particular amount, and preferably 0.1 part by weight to 20 parts by weight, and more preferably 0.2 part by weight to 10 parts by weight based on 100 parts by weight of the binder resin.

The colorant may be used as a masterbatch to be dispersed uniformly in the binder resin. Further, two or more of the colorants may be formed into a composite particle. The composite particles can be manufactured, for example, by adding an appropriate amount of water, lower alcohol and the like to two or more of colorants and granulating the mixture by a general granulating machine such as a high-speed mill, followed by drying. The masterbatch and the composite particles are mixed into the toner composition at the time of dry-mixing.

The toner base particle may contain a charge control agent in addition to the binder resin and the colorant. As the charge control agent, any types of charge control agent commonly used in this field for controlling positive charge and negative charge are usable.

Examples of the charge control agent for controlling positive charge include: basic dye, quaternary ammonium salt, quaternary phosphonium salt, aminopyrine, pyrimidine compounds, polynuclear polyamino compounds, aminosilane, nigrosine dye and derivatives thereof, triphenylmethane derivatives, guanidine salt and amidin salt.

Examples of the charge control agent for controlling negative charge include: oil-soluble dye such as oil black and spiron black; metal-containing azo compound; azo complex dye; naphthene acid metal salt; metal complex and metal salt of salicylic acid and its derivatives (metal: chrome, zinc, zirconium, or the like); boron compounds; fatty acid soap; long-chain alkylcarboxylic acid salt; and resin acid soap. The charge control agents may be used each alone, or two or more of them may be used in combination as needed. Although the amount of the charge control agent to be used is not particularly restricted and can be appropriately selected in a wide range, it should preferably fall in the range of 0.5% by weight or more and 3% by weight or less based on 100 parts by weight of the binder resin. Moreover, the charge control agent may be admixed in a coating layer made of fine resin particles in a coating step to be hereinafter described.

Further, the toner base particle may contain a release agent in addition to the binder resin and the colorant. As the release agent, it is possible to use ingredients which are customarily used in the relevant field, including, for example, petroleum waxes such as paraffin wax and derivatives thereof, and microcrystalline wax and derivatives thereof; hydrocarbon-based synthetic waxes such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable waxes such as carnauba wax and derivatives thereof, rice wax and derivatives thereof, candelilla wax and derivatives thereof, and haze wax; animal waxes such as bees wax and spermaceti wax; fat and oil-based synthetic waxes such as fatty acid amide and phenolic fatty acid ester; long-chain carboxylic acid and derivatives thereof; long-chain alcohol and derivatives thereof; silicone polymer; and higher fatty acid. Note that examples of the derivatives include oxides, block copolymers of vinylic monomer and wax, and graft-modified derivatives of vinylic monomer and wax. A usage of the wax may be appropriately selected from a wide range without particular limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

The volume average particle size of the toner base particles obtained through the toner base particle producing step S1 preferably falls in the range of 3 μm or more and 10 μm or less, and more preferably 5 μm or more and 8 μm or less. When the volume average particle size of the toner base particles falls in the range of 3 μm or more and 10 μm or less, high-resolution images can be produced with stability for a longer period of time.

However, when the volume average particle size of the toner base particles is less than 3 μm, then the toner base particles are so small in particle size that a resultant toner could be higher in charged level and lower in fluidity than it needs to be. The toner with too high a charged level and too low a fluidity cannot be supplied to the photoreceptor with stability, with consequent possibilities of occurrence of background fogging, a decline in image density, and so forth. By contrast, when the volume average particle size of the toner base particles exceeds 10 μm, then the toner base particles are so large in particle size that a produced image has a large layer thickness and thus appears very grainy. That is, high-resolution images cannot be produced. Furthermore, the larger the particle size of the toner base particles, the smaller the specific surface area, with consequent reduction in the amount of toner charging. If the amount of toner charging is reduced, the toner cannot be supplied to the photoreceptor with stability, with consequent possibility of internal apparatus contamination caused by toner scattering.

(2) Fine Particle Mixture Producing Step S2

Figure 1B:
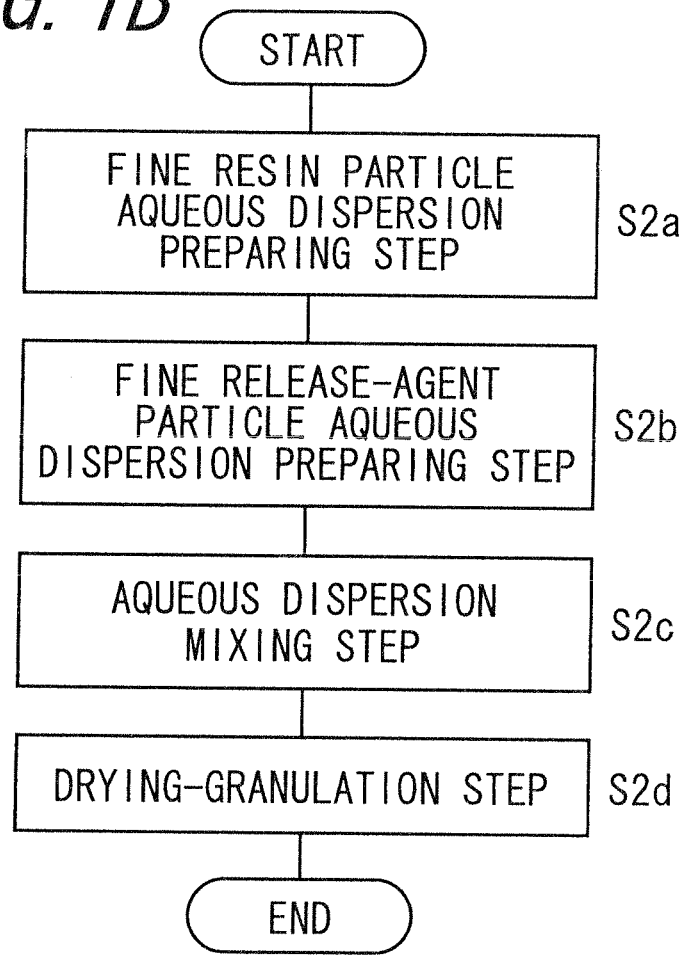
FIG. 1B is a flowchart showing a fine particle mixture producing step in FIG. 1A.

FIG. 1B is a flowchart showing the fine particle mixture producing step S2 in FIG. 1A. The fine particle mixture producing step S2 is a process for producing a fine particle mixture comprised of fine resin particles and fine release-agent particles, and comprises a fine resin particle aqueous dispersion preparing step S2*a*, a fine release-agent particle aqueous dispersion preparing step S2*b*, an aqueous dispersion mixing step S2*c*, and a drying-granulation step S2*d*. The fine resin particle aqueous dispersion preparing step S2*a*, the fine release-agent particle aqueous dispersion preparing step S2*b* and the aqueous dispersion mixing step S2*c* correspond to a first step, and a drying-granulation step S2*d* correspond to a second step.

(2-1) Fine Resin Particle Aqueous Dispersion Preparing Step S2*a*

In the fine resin particle aqueous dispersion preparing step S2*a*, there is prepared a fine resin particle aqueous dispersion formed of a water-based medium composed predominantly of water in which fine resin particles are dispersed in a stable condition, with its minute dispersion particle size maintained properly.

The fine resin particles are obtained for example by subjecting a resin used as a raw material for the fine resin particles to the process of emulsification and dispersion using a homogenizer, followed by performing grain refinement. Alternatively it can be obtained through polymerization of resin monomer components.

As the raw material for the fine resin particles, for example, a resin used as a toner material can be used, and examples thereof include polyester, an acrylic resin, a styrene resin, and a styrene-acrylic copolymer. Among the aforementioned resins, an acrylic resin and a styrene-acrylic copolymer are each desirable for use as a content. An acrylic resin and a styrene-acrylic copolymer have many advantages such as lightness in weight, high strength, high transparency, inexpensiveness, and easiness in obtaining constituents of uniform particle size.

Moreover, although the resin used as the raw material for the fine resin particles may be either of a resin of the same type as the binder resin contained in the toner base particles or of other different resin, from the standpoint of toner surface reforming treatment, the use of a resin of different type is desirable. In the case of using a resin of different type, it is preferable that the resin used as the raw material for the fine resin particles is higher in softening temperature than the binder resin contained in the toner base particles. In this case, in the toner produced by the manufacturing method of the embodiment, mutual fusion-bonding of toner can be prevented during storage, with consequent improvement in storage stability.

The volume average particle size of the fine resin particles needs to be sufficiently smaller than the average particle size of the toner base particles, and preferably falls in the range of 0.05 μm or more and 1 μm or less, and more preferably 0.1 μm or more and 0.5 μm or less. By setting the volume average particle size of the fine resin particles in the range of 0.05 μm or more and 1 μm or less, it is possible to create protuberances of desired dimension on the surfaces of the toner base particles. In this way, the toner produced by the method of the invention can be readily caught by a cleaning blade during a cleaning process, with consequent improvement in cleanability.

Although the amount of the fine resin particles to be added is not particularly restricted, in light of the necessity to cover the entire surfaces of the toner base particles properly, the fine resin particles are preferably used in a range of 1 part by weight or more and 30 parts by weight or less based on 100 parts by weight of the toner base particles. By using the fine resin particles according to such a proportion, it is possible to cause the fine resin particles to adhere to the entire surfaces of the toner base particles, and thereby form a coating layer over the entire surfaces of the toner base particles. As a result, toner aggregation resulting from the exudation of a low-melting-point component contained in the toner base particles can be prevented more reliably.

When the amount of the fine resin particles to be added is less than 1 part by weight, then it becomes impossible to cover the entire surfaces of the toner base particles, with consequent possibility of the exudation of a low-melting-point component contained in the toner base particles. Furthermore, the film thickness of the coating layer is so small that the release agent contained in the coating layer tends to exude to its surface. By contrast, when the amount of the fine resin particles to be added exceeds 30 parts by weight, then the film thickness of the coating layer is so large that, depending on the material of formation of the fine resin particles, the toner fixability could be deteriorated.

(2-2) Fine Release-Agent Particle Aqueous Dispersion Preparing Step S2*b*

In the fine release-agent particle aqueous dispersion preparing step S2*b*, there is prepared a fine release-agent particle aqueous dispersion formed of a water-based medium composed predominantly of water in which fine release-agent particles are dispersed in a stable condition, with its minute dispersion particle size maintained properly. For example, the fine release-agent particle aqueous dispersion is obtained by emulsifiably dispersing a release agent used as a raw material in a homogenizer or the like, followed by performing grain refinement, or obtained by substituting an aqueous medium for the release agent emulsifiably dispersed in a solvent. As the raw material for the fine release-agent particles, a release agent identical with that contained in the toner base particles is used.

The volume average particle size of the fine release-agent particles preferably falls in the range of 0.1 μm or more and 1.0 μm or less. When the volume average particle size of the fine release-agent particles is less than 0.1 μm, then the aggregation of the fine release-agent particles occurs in the course of toner production, with consequent difficulty in uniform dispersion. By contrast, when the volume average particle size of the fine release-agent particles exceeds 1.0 μm, then the fine release-agent particles tend to be exposed at toner surface, with consequent deterioration in blocking resistance.

It is preferable that an onset temperature of the fine release-agent particles based on differential scanning calorimetry is higher than or equal to 70° C. When the onset temperature of the fine release-agent particles is lower than 70° C., then blocking could occur because of high-temperature storage conditions, increased internal temperature of an in-use developer tank, and so forth.

(2-3) Aqueous Dispersion Mixing Step S2*c*

In the aqueous dispersion mixing step S2*c*, the fine resin particle aqueous dispersion prepared in the fine resin particle aqueous dispersion preparing step S2*a* and the fine release-agent particle aqueous dispersion prepared in the fine release-agent particle aqueous dispersion preparing step S2*b* are mixed together to prepare a fine particle mixture aqueous dispersion. In the fine particle mixture aqueous dispersion, the ratio of the fine release-agent particles to the fine resin particles in terms of weight should preferably fall in the range of 3% by weight or more and 30% by weight or less. When the ratio of the fine release-agent particles to the fine resin particles is less than 3% by weight, then the amount of the release agent contained in the resin coating layer is so small that desired effects cannot be attained. By contrast, when the ratio exceeds 30%, then the flowability and the storage stability under high-temperature conditions is deteriorated.

It is preferable that the fine release-agent particles in the resin coating layer formed in the process to be hereinafter described are contained in a range of 0.2 parts by weight or more and 2.3 parts by weight or less based on 100 parts by weight of the toner base particles. When the content of the fine release-agent particles in the resin coating layer is less than 0.2 parts by weight based on 100 parts by weight of the toner base particles, then the hot-offset resistance is deteriorated. By contrast, when the content of the fine release-agent particles exceeds 2.3 parts by weight based on 100 parts by weight of the toner base particles, then the blocking resistance is deteriorated.

(2-4) Drying-Granulation Step S2*d*

In the drying-granulation step S2*d*, the fine particle mixture aqueous dispersion prepared in the aqueous dispersion mixing step S2*c* is dehydrated and dried into a mixture of fine particles.

Examples of apparatuses that can be used for the dehydration process include a heated-air direct drying machine, a conduction heat-transfer drying machine, a far-infrared radiation drying machine, and a microwave radiation drying machine. The use of a heated-air direct drying machine (spray dryer) is desirable from the viewpoint of drying efficiency and workload. To be specific, Fujisaki Micro Mist Dryer Model MDL-050 (trade name) manufactured by Fujisaki Electric Co., Ltd. can be used.

In the fine particle mixture, the ratio in average particle size of the fine release-agent particles to the fine resin particles should preferably fall in the range of 0.3 or more and 2.0 or less. When the ratio of the average particle size of the fine release-agent particles to the average particle size of the fine resin particles is less than 0.3, then the aggregation of the fine release-agent particles occurs in the course of toner production, with consequent difficulty in uniform dispersion. By contrast, when the average particle-size ratio exceeds 2.0, then the fine release-agent particles tend to be exposed at toner surface, with consequent deterioration in blocking resistance.

(3) Fine Particle Mixture Adhering Step S3

In the fine particle mixture adhering step S3, the fine particle mixture prepared in the fine particle mixture producing step S2 is caused to adhere to the toner base particles produced in the toner base particle producing step S1, thereby forming coated toner particles.

Examples of apparatuses that can be used for the fine particle mixture adhering step S3 include: Henschel type mixing apparatuses such as HENSCHEL MIXER (trade name) manufactured by Mitsui Mining Co., Ltd., SUPER-MIXER (trade name) manufactured by Kawata MFG Co., Ltd., and MECHANOMILL (trade name) manufactured by Okada Seiko Co., Ltd.; ANGMILL (trade name) manufactured by Hosokawa Micron Corporation; HYBRIDIZATION SYSTEM (trade name) manufactured by Nara Machinery Co., Ltd.; and COSMOSYSTEM (trade name) manufactured by Kawasaki Heavy Industries, Ltd.

(4) Film-Forming Step S4

In the film-forming step S4, the coated toner particles obtained through the fine particle mixture adhering step S3 is sprayed with a liquid capable of plasticizing the toner base particles and the fine particle mixture while causing these particles in the presence of carrier gas to flow. Then, by the application of impact force, the fine particle mixture is turned into a film, thus forming a resin coating layer. In this way, capsule toner particles can be formed.

<Film-Forming Apparatus>

Figure 2:
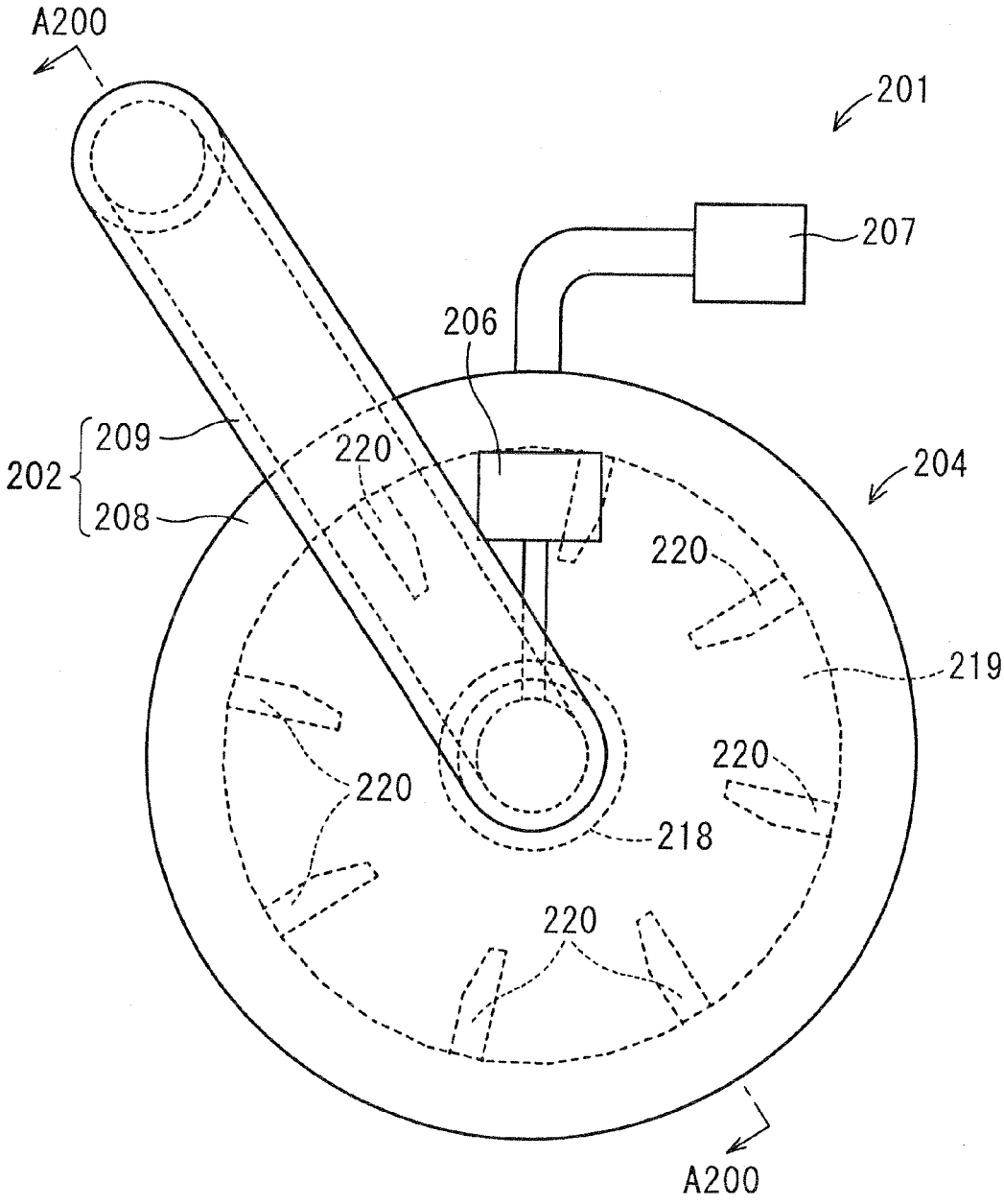
FIG. 2 is a front view showing the structure of a film-forming apparatus for use in the method of manufacturing the capsule toner of the invention.
Figure 3:
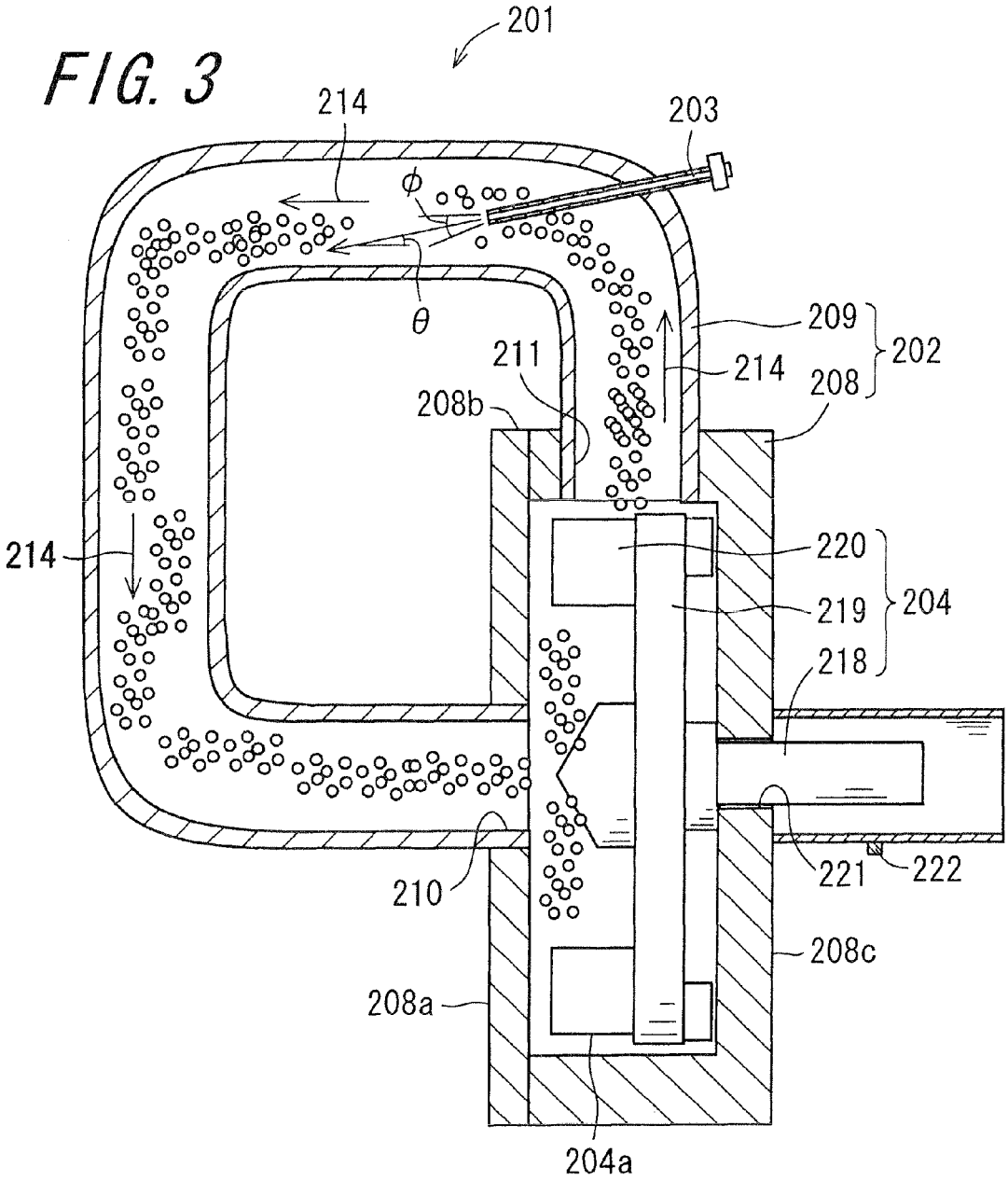
FIG. 3 is a schematic sectional view of the film-forming apparatus shown in FIG. 2 taken along the line A200-A200.

FIG. 2 is a front view showing the structure of a film-forming apparatus 201 for use in the capsule toner manufacturing method of the invention. FIG. 3 is a schematic sectional view of the film-forming apparatus 201 shown in FIG. 2 taken along the line A200-A200.

In the film-forming step S4, for example, with use of the film-forming apparatus 201 shown in FIG. 2, a resin film is formed on the toner base particles by exploiting the impact force resulting from a synergetic effect produced by circulation and agitation performed in said apparatus. The film-forming apparatus 201 is built as a rotary stirring apparatus composed of a powder passage 202, a spraying section 203, a rotary stirring section 204, a temperature regulation jacket (not shown), a powder inputting section 206, and a powder collecting section 207. The rotary stirring section 204 and the powder passage 202 constitute a circulating section.

(Powder Passage)

The powder passage 202 comprises a stirring section 208 and a powder flowing section 209. The stirring section 208 is a cylindrical container-like member having an internal space. Opening sections 210 and 211 are formed in the stirring section 208 which is a rotary stirring chamber. The opening section 210 is formed at an approximate center part of a surface 208*a* in one side of an axial direction of the stirring section 208 so as to penetrate a side wall including the surface 208*a* of the stirring section 208 in a thickness direction thereof. Moreover, the opening section 211 is formed at a side surface 208*b* perpendicular to the surface 208*a* in one side of the axial direction of the stirring section 208 so as to penetrate a side wall including the side surface 208*b* of the stirring section 208 in a thickness direction thereof. The powder flowing section 209 which is a circulation tube has one end connected to the opening section 210 and another end connected to the opening section 211. Whereby, the internal space of the stirring section 208 and the internal space of the powder flowing section 209 are communicated to form the powder passage 202. The coated toner particles and gas flow through the powder passage 202. The powder passage 202 is provided so that the powder flowing direction which is a direction in which the coated toner particles flow is constant.

The temperature in the powder passage 202 is set to a glass transition temperature of the toner base particle or less, and is preferably 30° C. or higher and not more than a glass transition temperature of the toner base particle. The temperature in the powder passage 202 is almost uniform at any parts by the flow of the toner base particles. In a case where the temperature in the powder passage 202 exceeds the glass transition temperature of the toner base particle, there is a possibility that the toner base particles are softened excessively and aggregation of the toner base particles is generated. Further, in a case where the temperature is lower than 30° C., the drying speed of the dispersion liquid is made slow and the productivity is lowered. Accordingly, in order to prevent aggregation of the toner base particles, it is necessary to maintain the temperatures of the powder passage 202 and the after-mentioned rotary stirring section 204 to the glass transition temperature of the toner base particle or less. Therefore, the after-mentioned temperature regulation jacket whose inner diameter is larger than the external diameter of the powder passage tube is disposed at least on a part of the outer side of the powder passage 202 and the rotary stirring section 204.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted in a through-h which is formed to penetrate the side wall including the surface 208*c* in the other side of the axial direction of the stirring section 208 in the thickness direction thereof, and that is rotated around the axis by a motor (not shown). The rotary disc 219 is a discotic member that has the axis supported by the rotary shaft member 218 so as to match the axis of the rotary shaft member 218 and that rotates with rotation of the rotary shaft member 218. The plurality of stirring blades 220 are supported by the peripheral edge of the rotary disc 219 and are rotated with rotation of the rotary disc 219.

In the film-forming step S4, the peripheral speed of the outermost periphery of the rotary stirring section 204 is preferably set to 30 m/sec or more, and more preferably to 50 m/sec or more. The outermost periphery of the rotary stirring section 204 is a part 204*a* of the rotary stirring section 204 that has the longest distance from the axis of the rotary shaft member 218 in the direction perpendicular to the extending direction of the rotary shaft member 218 of the rotary stirring section 204. In a case where the peripheral speed in the outermost periphery of the rotary stirring section 204 is set to 30 m/sec or more at the time of rotation, it is possible to isolate and fluidize the coated toner particles. In a case where the peripheral speed in the outermost periphery is less than 30 m/sec, it is impossible to isolate and fluidize the coated toner particles, thus making it impossible to uniformly coat the toner base particles with the resin film.

The coated toner particles preferably collide with the rotary disc 219 vertically. Whereby, it is possible to stir the coated toner particles sufficiently, to coat the toner base particles with the fine particle mixture more uniformly and to further improve yield of the toner in which the coating layer is uniform.

(Spraying Section)

The spraying section 203 is provided so as to be inserted in an opening formed on an outer wall of the powder passage 202, and in the powder flowing section 209, the spraying section 203 is provided in the powder flowing section that is on the side closest to the opening section 211 in the flowing direction of the coated toner particles.

The spraying section 203 sprays a spray liquid toward the coated toner particles. The spraying section 203 includes a liquid reservoir that reserves liquid, a carrier gas supplying section that supplies carrier gas, and a two-fluid nozzle that sprays, as the spray liquid, a mixture obtained by mixing the liquid and the carrier gas together, toward the coated toner particles present in the powder passage 202.

As the carrier gas, compressed air or the like is usable. The liquid, which has been fed to the spraying section 203 by a liquid feeding pump with a constant volume of flow and then sprayed by the spraying section 203, is spread on the surfaces of the coated toner particles.

(Temperature Regulation Jacket)

The temperature regulation jacket (not shown), which is a temperature regulation section, is provided at least on a part of the outside of the powder passage 202 and regulates temperatures in the powder passage 202 and of the rotary stirring section 204 to a predetermined temperature by passing a cooling medium or a heating medium through the internal space of the jacket. This makes it possible to control the temperature in the powder passage and outside of the rotary stirring section to a temperature or less at which the toner base particles and the fine particle mixture are not softened and deformed. Moreover, in the film-forming step S4, a variation in the temperatures applied to the toner base particles, the fine particle mixture and the liquid can be reduced, and thus the stable fluidizing state of the coated toner particles can be kept.

In the embodiment, the temperature regulation jacket is preferably provided over the entire outside of the powder passage 202. The coated toner particles generally collide with the inner wall of the powder passage 202 many times, and a part of the collision energy is converted into the thermal energy at the time of collision and is accumulated in the toner base particles and the fine particle mixture. As the number of the collision increases, the thermal energy accumulated in the particles increases and then the toner base particles and the fine particle mixture are softened to adhere to the inner wall of the powder passage 202. By providing the temperature regulation jacket over the entire outside of the powder passage 202, an adhesive force of the toner base particles and the fine particle mixture to the inner wall of the powder passage 202 is lowered so that it is possible to reliably prevent adhesion of the toner base particles to the inner wall of the powder passage 202 due to a rapid temperature rise in the apparatus and thus to avoid the narrowing inside the powder passage 202 due to the toner base particles and the fine particle mixture. Accordingly, the toner base particles are coated with the fine resin particles uniformly, resulting that it is possible to manufacture a toner excellent in cleaning property in higher yield.

Further, in the inside of the powder flowing section 209 downstream of the spraying section 203, the sprayed liquid remains undried, and thus, if the temperature is improper, the drying speed is made slow and the liquid is easily retained. When the coated toner particles are in contact therewith, the coated toner particles are easily adhered to the inner wall of the powder passage 202, which becomes an aggregation generation source of the toner. In the inner wall near the opening section 210, the coated toner particles that flow into the stirring section 208 collide with the coated toner particles that flow in the stirring section 208 with stirring of the rotary stirring section 204, thereby the collided coated toner particles are easily adhered to the vicinity of the opening section 210. Accordingly, by providing the temperature regulation jacket in such a part to which the coated toner particles are easily adhered, it is possible to prevent the coated toner particles from being adhered to the inner wall of the powder passage 202 more reliably.

(Powder Inputting Section and Powder Collecting Section)

Figure 4:
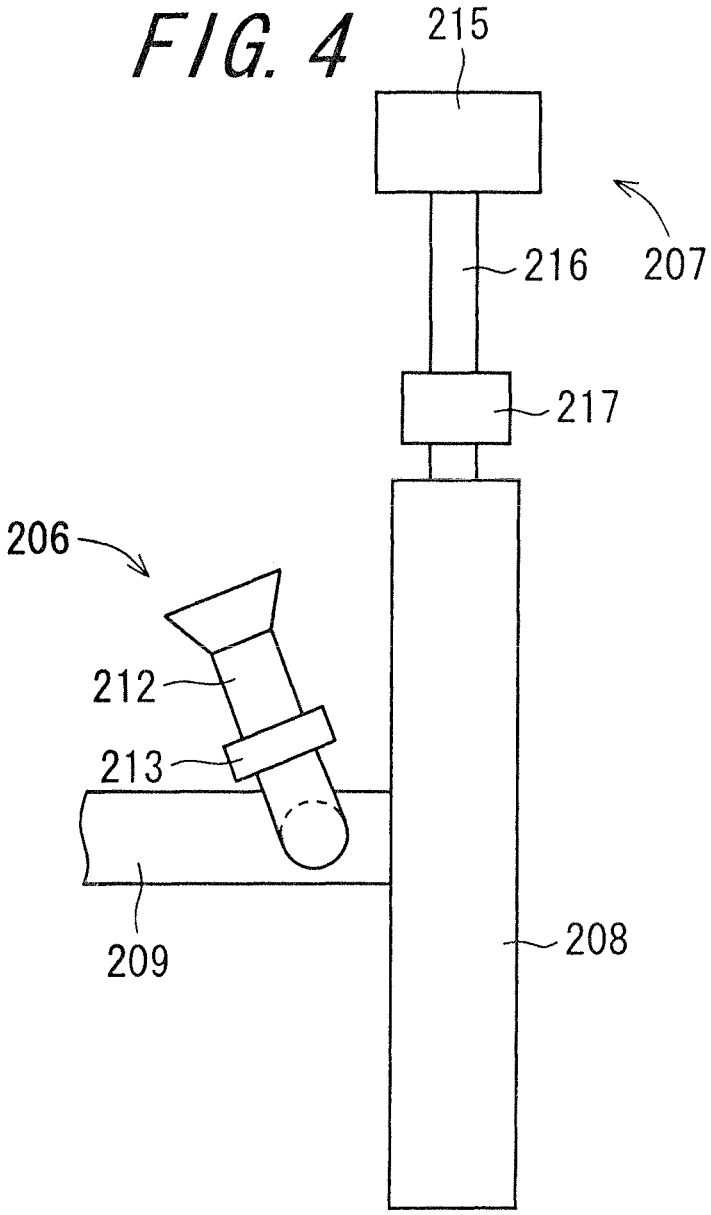
FIG. 4 is a side view showing the structure around a powder inputting section and a powder collecting section.

The powder flowing section 209 of the powder passage 202 is connected with the powder inputting section 206 and the powder collecting section 207. FIG. 4 is a side view showing the structure around the powder inputting section 206 and the powder collecting section 207.

The powder inputting section 206 includes a hopper (not shown) that supplies the coated toner particles, a supplying tube 212 that communicates the hopper and the powder passage 202, and an electromagnetic valve 213 provided in the supplying tube 212. The coated toner particles supplied from the hopper are supplied to the powder passage 202 through the supplying tube 212 in a state where the passage in the supplying tube 212 is opened by the electromagnetic valve 213. The coated toner particles supplied to the powder passage 202 flow in the constant powder flowing direction with stirring by the rotary stirring section 204. Moreover, the coated toner particles are not supplied to the powder passage 202 in a state where the passage in the supplying tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing through the powder passage 202 are not collected in a state where the passage in the collecting tube 216 is closed by the electromagnetic valve 217.

The liquid having an effect of not dissolving but plasticizing the toner base particles and the fine particle mixture is not particularly limited, and is preferably a liquid that is easily vaporized since the liquid needs to be removed from these particles after spraying. Such a liquid preferably includes a liquid including water or lower alcohol.

Examples of the lower alcohol include methanol, ethanol, and propanol. The use of a spray liquid containing such lower alcohol makes it possible to enhance the wettability of the fine particle mixture with respect to the toner base particles, and thereby facilitate the formation of the coating layer on the entire or most part of the surfaces of the toner base particles. Moreover, the toner base particles and the fine particle mixture in a plasticized state are changed in shape by external force, whereby a coating layer can be formed uniformly on the surfaces of the toner base particles. Further, the time of drying required to remove the spray liquid can be reduced even further. Better still, the time of drying in the liquid removal gets even shorter, wherefore aggregation of the toner base particles can be suppressed.

Further, the viscosity of the liquid sprayed is preferably 5 cP or less. The viscosity of the liquid is measured at 25° C., and can be measured, for example, by a cone/plate type rotation viscometer. A preferable example of the liquid having the viscosity of 5 cP or less includes alcohol. Examples of the alcohol include methyl alcohol and ethyl alcohol. These types of alcohol have low viscosity and are easily vaporized, and therefore, when the liquid includes the alcohol, it is possible to spray the liquid with a minute droplet diameter without coarsening a diameter of the spray droplet of the liquid to be sprayed from the spraying section 203. It is also possible to spray the liquid with a uniform droplet diameter. It is possible to further promote fining of the droplet at the time of collision of the toner base particles and the droplets. This makes it possible to uniformly wet the surfaces of the toner base particles and the fine particle mixture with the liquid, fit the liquid to the surfaces of the toner base particles and the fine particle mixture and soften the fine particle mixture by a multiplier effect with collision energy. As a result, it is possible to obtain a capsule toner having excellent uniformity.

The spray liquid is not limited to the substances thus far described, but may be of alcohols such as butanol, diethylene glycol, and glycerin, ketones such as acetone and methylethyl ketone, or esters such as methyl acetate and ethyl acetate.

It is preferable that the sprayed liquid is gasified such that the interior of the powder passage 202 can be kept at a constant gas concentration, and the gasified liquid is exhausted through the through-h to the outside of the powder passage 202. In this case, the gasified liquid in the powder passage 202 can be kept at a constant concentration, and the liquid can be dried faster than in the case where the concentration is not kept constant. This makes it possible to prevent toner particles still bearing undried liquid components from adhering to another toner particles, and thereby suppress aggregation of the toner particles. As a result, it is possible to further improve yield of the toner in which the coating layer is uniform.

The concentration of the gasified liquid measured by a concentration sensor in a gas exhausting section 222 is preferably around 3% by weight or less. In a case where the concentration is around 3% by weight or less, the drying speed of the liquid can be increased sufficiently, thus making it possible to prevent adhesion of the toner particles on which the undried liquid remains to other toner particles and to prevent aggregation of the toner particles. Moreover, the concentration of the gasified liquid is more preferably 0.1% by weight or more and 3.0% by weight or less. In a case where the concentration falls within this range, it is possible to prevent aggregation of the toner base particles without lowering the productivity.

In the embodiment, it is preferable that the liquid is started to be sprayed after the flow rate of the toner base particles and the coated toner particles is stabilized in the powder passage 202. Whereby, it is possible to spray the liquid to the coated toner particles uniformly, thus making it possible to improve yield of the toner in which the coating layer is uniform.

In the film-forming step S4, the rotary stirring section 204 is operated to continue its stirring action at a predetermined temperature until the fine particle mixture adherent to the toner base particles are softened into a film-like form, and the coated toner particles are caused to flow so that the fine particle mixture is turned into a film on the surfaces of the toner base particles.

The configuration of such a film-forming apparatus 201 is not limited to the above and various alterations may be added thereto. For example, the temperature regulation jacket may be provided over the entire outside of the powder flowing section 209 and the stirring section 208, or may be provided in a part of the outside of the powder flowing section 209 or the stirring section 208. In a case where the temperature regulation jacket is provided over the entire outside of the powder flowing section 209 and the stirring section 208, it is possible to prevent the coated toner particles from being adhered to the inner wall of the powder passage 202 more reliably.

Further, instead of the film-forming apparatus 201, a combination of a commercially available stirring apparatus and the spraying section can be used. An example of the commercially available stirring apparatus provided with the powder passage and the rotary stirring section includes HYBRIDIZATION SYSTEM (trade name, manufactured by Nara Machinery Co., Ltd.) By installing a liquid spraying unit in such a stirring apparatus, this stirring apparatus is usable as the film-forming apparatus.

(5) External Addition Step S5

In the external addition step S5, an external additive is adherently applied to the surfaces of capsule toner particles obtained through the film-forming step S4. As the external additive, a heretofore known agent, for example, silica, titanium oxide, etc. can be used. Moreover, such an external additive is preferably subjected to a surface treatment using a silane coupling agent, a silicone resin, or the like. It is preferable that the external additive is used in an amount of 1 to 10 parts by weight based on 100 parts by weight of the capsule toner.

Figure 5:
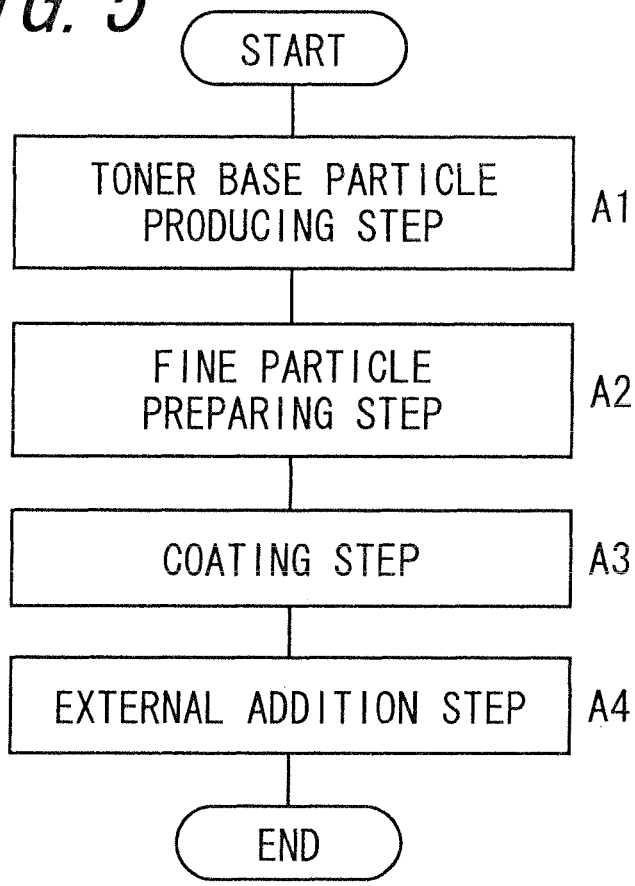
FIG. 5 is a flowchart showing a second procedure of the method of manufacturing the capsule toner in accordance with one embodiment of the invention.

FIG. 5 is a flowchart showing a second procedure of the method of manufacturing the capsule toner in accordance with one embodiment of the invention. The second procedure of the method of manufacturing the capsule toner of the invention includes a toner base particle producing step A1, a fine particle preparing step A2, a coating step A3, and an external addition step A4.

<Toner Base Particle Producing Step A1>

The toner base particle producing step A1 is performed in a similar manner to that for the foregoing toner base particle producing step S1, and therefore the description thereof will be omitted.

<Fine Particle Preparing Step A2>

In the fine particle preparing step A2, dried fine resin particles and fine release-agent particles are prepared. Any given method can be used for a drying process. For example, dried fine resin particles can be obtained by means of heated-air direct drying, conduction heat-transfer drying, far-infrared radiation drying, microwave radiation drying, or the like. The fine resin particles are used for a resin coating layer covering the toner base particles in the subsequent coating step A3. By applying a coating of the fine resin particles to the surfaces of the toner base particles, it is possible to prevent development of toner aggregation during toner storage resulting for example from the melting of a low melting-point component such as a release agent contained in the toner base particles. Moreover, for example, when the toner base particles are covered with a liquid in which fine resin particles are dispersed by a spraying treatment, the fine resin particles remain in shape on the surfaces of the toner base particles. This makes it possible to obtain a toner which is superior to a toner having smoothed surfaces in point of cleanability. As a raw material for the fine resin particles, the aforementioned resins can be used.

Although the amount of the fine resin particles to be added is not particularly restricted, in light of the necessity to cover the entire surfaces of the toner base particles properly, the fine resin particles are preferably used in a range of 1 part by weight or more and 30 parts by weight or less based on 100 parts by weight of the toner base particles. By using the fine resin particles according to such a proportion, it is possible to cause the fine resin particles to adhere to the entire surfaces of the toner base particles, and thereby form a coating layer over the entire surfaces of the toner base particles. As a result, toner aggregation resulting from the exudation of a low-melting-point component contained in the toner base particles can be prevented more reliably.

When the amount of the fine resin particles to be added is less than 1 part by weight, then it becomes impossible to cover the entire surfaces of the toner base particles, with consequent possibility of the exudation of a low-melting-point component contained in the toner base particles. Furthermore, the film thickness of the coating layer is so small that the release agent contained in the coating layer tends to exude to its surface. By contrast, when the amount of the fine resin particles to be added exceeds 30 parts by weight, then the thickness of the coating layer is so large that, depending on the material of formation of the fine resin particles, the toner fixability could be deteriorated.

<Coating Step A3>

The coating step A3 is performed with use of a surface reforming apparatus, for example. A first surface reforming apparatus is built as an apparatus comprising a container for accommodating therein the toner base particles, the fine resin particles and the fine release-agent particles, and a spraying section for spraying a spray liquid into the container. Moreover, in the embodiment, the first surface reforming apparatus has a stirring section for stirring the toner base particles stored in the container.

As the container for accommodating therein the toner base particles, the fine resin particles, and the fine release-agent particles, a container of closed type can be used.

The spraying section comprises a spray liquid storage portion for storing spray liquid, a carrier gas storage portion for storing carrier gas, and a liquid spraying unit for spraying a mixture obtained by mixing the spray liquid and the carrier gas toward the toner base particles stored in the container so that the toner base particles are sprayed with droplets of the spray liquid.

As the carrier gas, compressed air or the like can be used. As the liquid spraying unit, a commercially available product can be used. For example, a unit constructed by connecting a tube pump (trade name: Model MP-1000A, manufactured by Tokyo Rikakikai Co., Ltd.) to a two-fluid nozzle (trade name: Model HM-6, manufactured by FUSO SEIKI Co., Ltd.) can be used. In this construction, the spray liquid is fed through the tube pump to the two-fluid nozzle at a constant feed rate.

As the stirring section, for example, a stirring rotor capable of imparting mechanical and thermal energy based mainly on impact force to the toner base particles is used.

As the container with the stirring section, a commercially available product can be used. Examples thereof include: Henschel type mixing apparatuses such as HENSCHEL MIXER (trade name) manufactured by Mitsui Mining Co., Ltd., SUPERMIXER (trade name) manufactured by Kawata MEG Co., Ltd., and MECHANOMILL (trade name) manufactured by Okada Seiko Co., Ltd.; ANGMILL (trade name) manufactured by Hosokawa Micron Corporation; HYBRIDIZATION SYSTEM (trade name) manufactured by Nara Machinery Co., Ltd.; and COSMOSYSTEM (trade name) manufactured by Kawasaki Heavy Industries, Ltd. With the provision of the liquid spraying unit within the container of such a mixing apparatus, the mixing apparatus can be used as the surface reforming apparatus of the embodiment.

It is preferable that the internal temperature of the container of the surface reforming apparatus is lower than the glass transition temperature of the binder resin contained in the toner base particles. When the temperature is at this level, aggregation of the toner base particles resulting from their excessive melting within the container can be prevented. When the internal temperature of the container is higher than or equal to the glass transition temperature of the binder resin contained in the toner base particles, then the toner base particles are melted excessively within the container, with consequent possibility of aggregation of the toner base particles. Besides, in order to prevent aggregation of the toner base particles, the interior of the container of the surface reforming apparatus is preferably cooled down as needed.

The toner base particles are covered with the fine resin particles as follows. To begin with, the toner base particles and the fine release-agent particles are put into the container and stirred by the stirring section. After the fine release-agent particles have adhered dispersively to the surfaces of the toner base particles, the fine resin particles are put therein. Under conditions where the toner base particles, the fine release-agent particles and the fine resin particles are stirred by the stirring section, the spray liquid is sprayed into the container. The surfaces of the toner base particles and the fine resin particles are swollen and softened by the spraying of the spray liquid and the application of thermal energy generated by the stirring action. In addition to this, by the application of mechanical impact force exerted by the stirring section, the fine resin particles adhere fixedly to the surfaces of the toner base particles, and also part of the fine resin particles is fusion-bonded to at least one of the toner base particles and the adjoining fine resin particles. The spray liquid used at this time does not have the effect of plasticizing the fine release-agent particles, wherefore the fine release-agent particles are not softened. In consequence, the fine release-agent particles are buried in the toner base particles or the fine resin particles under the mechanical impact force and are thus hardly exposed at the surface of the coating layer.

The use of the foregoing surface reforming apparatus makes it possible to facilitate the setting of the proportions of, respectively, the toner base particles and the fine resin particles to be used, and thereby adjust the thickness of the coating layer to a desired level. Moreover, in the surface reforming apparatus, the provision of the stirring section makes it possible to achieve the adhesion of a uniform amount of the fine resin particles onto the toner base particles, and thereby obtain a toner with uniformity in chargeability.

Following the completion of formation of the resin coating layer containing the fine release-agent particles on the surfaces of the toner base particles, the spray liquid is removed. The removal of the spray liquid is achieved by vaporizing the spray liquid with use of a drying machine. A commonly-used drying machine, for example, a heated-air direct drying machine, a conduction heat-transfer drying machine, and a freeze-drying machine can be used for the removal of the spray liquid. Preferably, after stopping the supply of the spray liquid in the apparatus used for the step of forming the resin coating layer, stirring is carried out for a predetermined period of time so that the spray liquid can be vaporized to effect drying.

The external addition step A4 is performed in a similar manner to that for the foregoing external addition step S5, and therefore the description thereof will be omitted.

2. Capsule Toner

A toner in accordance with an embodiment of the invention is produced by the method of manufacturing the capsule toner of the foregoing embodiment. The capsule toner obtained by the method of manufacturing the capsule toner is a capsule toner in which a resin coating layer containing fine release-agent particles is formed on the surfaces of toner base particles, and thus offers excellent offset resistance and a wider fixable temperature range without impairing blocking resistance.

3. Two-Component Developer

The capsule toner of the invention can be used in admixture with carrier as a two-component developer.

As the carrier, heretofore known substances can be used including, for example, single or complex ferrite composed of iron, copper, zinc, nickel, cobalt, manganese, chromium and the like; a resin-coated carrier having carrier core particles whose surfaces are coated with coating substances; or a resin-dispersion carrier in which magnetic particles are dispersed in resin.

As the coating substance, heretofore known substances can be used including, for example, polytetrafluoroethylene, monochloro-trifluoroethylene polymer, polyvinylidene-fluoride, silicone resin, polyester resin, metal compound of di-tertiary-butylsalicylic acid, styrene resin, acrylic resin, polyamide, polyvinyl butyral, nigrosine, aminoacrylate resin, basic dye or lake thereof, fine silica powder, and fine alumina powder. In addition, the resin used for the resin-dispersion carrier is not limited to a particular resin, and examples thereof include styrene-acrylic resin, polyester resin, fluorine resin, and phenol resin. Both of the coating substance and the resin are preferably selected according to the toner components. Those substances and resins listed above may be used each alone, or two or more of them may be used in combination.

A particle of the carrier preferably has a spherical shape or flattened shape. A particle size of the carrier is not limited to a particular size, and in consideration of forming higher-quality images, the particle size of the carrier is preferably 10 μm to 100 μm and more preferably 20 μm to 50 μm.

A use ratio of the toner to the carrier in the two-component developer is not limited to a particular ratio, and the use ratio is appropriately selected according to the types of the toner and the carrier. For example, in a case where the toner is mixed with the resin-coated carrier (having density of 5 g/cm$^2$ to 8 g/cm$^2$), the toner may be contained such that a content of the toner in the developer is 2% by weight to 30% by weight and preferably 2% by weight to 20% by weight of the total amount of the developer. Further, coverage of the carrier with the toner is preferably 40% to 80%.

EXAMPLES

Hereinafter, the invention will be concretely described by way of implemented examples and comparative examples. In the following description, expressions such as a term "part (parts)" and a symbol "%" refer to "part (parts) by weight" and "% by weight", respectively, unless otherwise specified. In the implemented examples and comparative examples, the glass transition temperature (Tg) and softening temperature (Tm) of the resin, the melting point and onset temperature of the fine release-agent particles, the volume average particle size and coefficient of variation of the toner base particles, the volume average particle size of the fine resin particles as well as the fine release-agent particles, and the dispersion particle size of the fine release-agent particles have been measured in the following procedure.

[Glass Transition Temperature of Resin]

A sample of 1 g is prepared for use, and, with use of a differential scanning calorimeter (trade name: DSC 220, manufactured by Seiko Instruments & Electronics Ltd.) and in conformity with Japan Industrial Standards (JIS) K7121-1987, the sample is heated at a temperature elevation rate of 10° C./min to measure a DSC curve. In the thereby obtained DSC curve, there is determined a point of intersection between a straight line obtained by extending the base line at the high temperature side of the endothermic peak corresponding to glass transition to the low temperature side and a tangential line drawn at a point where the gradient is at the maximum with respect to the curve from the starting part to the vertex of the peak. A temperature at this intersection point is defined as the glass transition temperature (Tg).

[Softening Temperature of Resin]

In a rheological characteristics evaluation apparatus (trade name: Flow Tester CFT-100C, manufactured by Shimadzu Corporation), 1 g of a sample is heated at a temperature elevation rate of 6° C./min and is subjected to a load of 20 kgf/cm$^2$ ($19.6\times10^5$ Pa). Then, a temperature at which half of the sample is flown out of a die (1 mm in nozzle bore diameter and 1 mm in length) is determined. This temperature is defined as the softening temperature (Tm).

[Melting Point and Onset Temperature of Fine Release-Agent Particles]

With use of a differential scanning calorimeter (trade name: DSC 220, manufactured by Seiko Instruments & Electronics Ltd.), 1 g of a sample is heated from 20° C. to 200° C. at a temperature elevation rate of 10° C./min, and is thereafter cooled rapidly from 200° C. down to 20° C. This operation is repeated twice to measure DSC curves. A temperature at the endothermic peak corresponding to fusion of the DSC curve measured in the second run is defined as the melting point of the fine release-agent particles. In the thereby obtained DSC curve, there is determined a point of intersection between a straight line obtained by extending the base line at the low temperature side of the endothermic peak corresponding to fusion to the high temperature side and a tangential line drawn at a point where the gradient is at the maximum with respect to the curve from the starting part to the vertex of the peak. A temperature at this intersection point is defined as an onset temperature.

[Dispersion Particle Size of Fine Release-Agent Particles]

Prepared toner particles are embedded in a resin to be cut into a thin slice with a dimension of approximately 80 nm by means of a microtome. The slice is observed by using a transmission type microscope to measure the area of the whole of release-agent components present in a resin coating layer observed like a white spot. The diameter of the area in a sphere-converted state is determined, and the diameter range obtained through the observation is defined as the range of the dispersion particle size.

[Volume Average Particle Size and Coefficient of Variation of Toner Base Particles]

To 50 ml of an electrolysis solution (trade name: ISOTON-II, manufactured by Beckman Coulter, Inc.), 20 mg of a sample and 1 ml of sodium alkyl ether sulfate are added. The resultant admixture is subjected to dispersion treatment for 3 minutes at a frequency of 20 kHz in a supersonic disperser (trade name: UH-50, manufactured by SMT Co., Ltd.) thereby to prepare a specimen for measurement. Then, under conditions where an aperture diameter is 100 μm and the number of particles to be measured is 50000 counts, measurement is performed on the specimen for measurement by means of a particle size distribution measuring apparatus (trade name: Multisizer 3, manufactured by Beckman Coulter, Inc.) to determine a volume average particle size and a standard deviation in volume particle size distribution on the basis of the volume particle size distribution of the particles of the specimen. A coefficient of variation (CV value (%)) is obtained by calculation in accordance with the following formula:

$$\text{CV value}(\%)=(\text{Standard deviation in volume particle size distribution}/\text{Volume average particle size})\times 100$$

[Volume Average Particle Size of Fine Resin Particles and Fine Release-Agent Particles]

Measurement is performed by using a particle size distribution analyzer of laser diffraction/scattering system (trade name: Model LA-920, manufactured by HORIBA, Ltd.). A particle size at a cumulative frequency of 50% in volume terms (median diameter: D50) is defined as a volume average particle size.

Example 1

| | |
|---|---|
| Polyester resin (trade name: Tafton, manufactured by KAO Corporation, glass transition temperature of 60° C. and softening temperature of 138° C.) | 88 parts |
| Colorant (copper phthalocyanine, C.I. Pigment Blue 15:3) | 5 parts |
| Release agent (Carnauba wax manufactured by Toa Kasei Co., Ltd., melting point of 82° C.) | 5 parts |
| Charge control agent (trade name: BONTRON E-84, manufactured by Orient Chemical Industries, Ltd.) | 2 parts |

The above raw materials were mixed together for dispersion for 3 minutes by Henschel Mixer, and the resultant admixture was melt-kneaded for dispersion by using a twin-screw extruder (trade name: Model PCM-30, manufactured by Ikegai, Ltd.). The twin-screw extruder was operated under conditions where a cylinder setting temperature is 110° C., the number of barrel revolutions was 300 rpm, and a raw-material supply rate was 20 kg/hr. The resultant toner melt-kneaded product was cooled down by a cooling belt, and was whereafter coarsely crushed by a speed mill having a screen of 2 mm in diameter. The coarsely crushed product was pulverized into fine particles by a jet-type pulverizer (trade name: Model IDS-2, manufactured by Nippon Pneumatic Mfg. Co., Ltd.), and the particles were subjected to classification in Elbow-Jet classifier (trade name) manufactured by Nittetsu Mining Co., Ltd. In this way, there were obtained toner base particles (volume average particle size: 6.9 μm, coefficient of variation: 22)

[Fine Particle Mixture Producing Step S2]

Styrene-acrylate-butyl acrylate copolymer resin (trade name: SK 540, manufactured by Sanyo Chemical Industries, Ltd.), 5 g of surfactant polyoxyethylene alkyl ether (trade name: EMULGEN 1108, manufactured by KAO Corporation), and 1985 g of distilled water were put into a high-pressure homogenizer while being heated to 95° C. thereby to obtain an aqueous dispersion J1 (solid content concentration: 5%) of fine resin particles (volume average particle size: 150 nm, glass transition temperature: 64° C., softening temperature: 120° C.)

Into a high-pressure homogenizer, 100 g of Fischer-Tropsch wax (trade name: FNP 0090, manufactured by NIPPON SEIRO Co., Ltd.), 5 g of surfactant polyoxyethylene alkyl ether (trade name: EMULGEN 1108, manufactured by KAO Corporation), and 1985 g of distilled water were put while being heated to 95° C. thereby to obtain an aqueous dispersion W1 (solid content concentration: 5%) of fine release-agent particles 1 (volume average particle size: 150 nm, melting-point peak temperature: 90° C., onset temperature: 82° C.)

There were mixed together 2000 g of the aqueous dispersion J1 of the fine resin particles and 200 g of the aqueous dispersion W1 of the fine release-agent particles 1 in a liquid state at 20° C. thereby to obtain a fine particle mixture aqueous dispersion 1 (the ratio of the fine release-agent particles to the fine resin particles: 10% by weight).

The fine particle mixture aqueous dispersion 1 was dehydrated and dried by using Fujisaki Micro Mist Dryer Model MDL-050 (trade name) manufactured by Fujisaki Electric Co., Ltd. thereby to form a fine particle mixture 1.

[Fine Particle Mixture Adhering Step S3]

Into Henschel Mixer (trade name) manufactured by Mitsui Mining Co., Ltd., 100 parts of the toner base particles and 8.25 parts of the fine particle mixture 1 were put and mixed together for 5 minutes at a circumferential velocity of 20 m/sec thereby to form coated toner particles.

[Film-Forming Step S4]

The coated toner particles were put into a film-forming apparatus (trade name: Hybridizer Model NHS-1, manufactured by Nara Machinery Co., Ltd.), and were subjected to an impact force while being sprayed with ethanol thereby to obtain capsule toner particles (volume average particle size: 7.0 μm, coefficient of variation: 23, dispersion particle size of release agent: 0.1 μm to 0.3 μm).

[External Addition Step S5]

There were mixed together 100 parts of the capsule toner particles, 0.5 part of fine hydrophobic silica particles (trade name: KE-P 10, manufactured by Nippon Shokubai Co., Ltd) having an average primary particle size of 100 nm, 1.0 part of small-diameter fine hydrophobic silica particles (trade name: RX-200, manufactured by Nippon Aerosil Co., Ltd.) having an average primary particle size of 12 nm, and 0.6 part of hydrophobic titanium oxide having an average primary particle size of 40 nm for 3 minutes in Henschel Mixer thereby to obtain a capsule toner of Example 1 (volume average particle size: 7.0 μm, coefficient of variation: 23).

Example 2

There was obtained an aqueous dispersion W2 (solid content concentration: 5%) of fine release-agent particles (volume average particle size: 300 nm, melting-point peak temperature: 90° C., onset temperature: 82° C.) basically in the same manner as in the case of Example 1, except that, in the fine particle mixture producing step S2, surfactant and distilled water were put in an amount of 1.2 g and in an amount of 1899 g, respectively, at the time of preparation of the aqueous dispersion of the fine release-agent particles. There was also obtained a fine particle mixture aqueous dispersion 2 (the ratio of the fine release-agent particles to the fine resin particles: 5% by weight) basically in the same manner as in the case of Example 1, except that 100 g of the aqueous dispersion W2 of the fine release-agent particles 2 was used in lieu of the aqueous dispersion W1 of the fine release-agent particles 1. A fine particle mixture 2 was produced from the thus obtained fine particle mixture aqueous dispersion 2.

There was obtained a capsule toner of Example 2 (volume average particle size: 7.0 μm, coefficient of variation: 23, dispersion particle size of release agent: 0.1 μm to 0.5 μm) basically in the same manner as in the case of Example 1, except that, in the fine particle mixture adhering step S3, 7.88 parts of the fine particle mixture 2 was used in lieu of the fine particle mixture 1.

Example 3

There was obtained a fine particle mixture aqueous dispersion 3 (the ratio of the fine release-agent particles to the fine resin particles: 3% by weight) basically in the same manner as in the case of Example 1, except that, in the fine particle mixture producing step S2, the aqueous dispersion W1 of the fine release-agent particles 1 was put in an amount of 60 g. A fine particle mixture 3 was produced from the fine particle mixture aqueous dispersion 3.

There was obtained a capsule toner of Example 3 (volume average particle size: 7.0 μm, coefficient of variation: 23, dispersion particle size of release agent: 0.1 μm to 0.3 μm) basically in the same manner as in the case of Example 1, except that, in the fine particle mixture adhering step S3, 7.73 parts of the fine particle mixture 3 was used in lieu of the fine particle mixture 1.

Example 4

There was obtained a fine particle mixture aqueous dispersion 4 (the ratio of the fine release-agent particles to the fine resin particles: 20% by weight) basically in the same manner as in the case of Example 1, except that, in the fine particle mixture producing step S2, the aqueous dispersion W1 of the fine release-agent particles 1 was put in an amount of 400 g. A fine particle mixture 4 was produced from the fine particle mixture aqueous dispersion 4.

There was obtained a capsule toner of Example 4 (volume average particle size: 7.0 μm, coefficient of variation: 23, dispersion particle size of release agent: 0.1 μm to 0.3 μm) basically in the same manner as in the case of Example 1, except that, in the fine particle mixture adhering step S3, 9.0 parts of the fine particle mixture 4 was used in lieu of the fine particle mixture 1.

Example 5

There was obtained a fine particle mixture aqueous dispersion 5 (the ratio of the fine release-agent particles to the fine resin particles: 30% by weight) basically in the same manner as in the case of Example 1, except that, in the fine particle mixture producing step S2, the aqueous dispersion W1 of the fine release-agent particles 1 was put in an amount of 600 g. A fine particle mixture 5 was produced from the fine particle mixture aqueous dispersion 5.

There was obtained a capsule toner of Example 5 (volume average particle size: 7.0 μm, coefficient of variation: 23, dispersion particle size of release agent: 0.1 μm to 0.3 μm) basically in the same manner as in the case of Example 1, except that, in the fine particle mixture adhering step S3, 9.75 parts of the fine particle mixture 5 was used in lieu of the fine particle mixture 1.

Example 6

There was obtained an aqueous dispersion W3 (solid content concentration: 5%) of fine release-agent particles 3 (volume average particle size: 300 nm, melting-point peak temperature: 98° C., onset temperature: 70° C.) basically in the same manner as in the case of Example 1, except that, in the fine particle mixture producing step S2, 100 g of polyethylene wax (trade name: PW 655N, manufactured by Toyo Petrolite Co., Ltd.) was used in lieu of Fischer-Tropsch wax at the time of preparation of the aqueous dispersion of the fine release-agent particles. There was also obtained a fine particle mixture aqueous dispersion 6 (the ratio of the fine release-agent particles to the fine resin particles: 10% by weight) basically in the same manner as in the case of Example 1, except that 100 g of the aqueous dispersion W3 of the fine release-agent particles 3 was used in lieu of the aqueous dispersion W1 of the fine release-agent particles 1. A fine particle mixture 6 was produced from the fine particle mixture aqueous dispersion 6.

There was obtained a capsule toner of Example 6 (volume average particle size: 7.0 μm, coefficient of variation: 23, dispersion particle size of release agent: 0.1 μm to 0.5 μm) basically in the same manner as in the case of Example 1, except that, in the fine particle mixture adhering step S3, 8.25 parts of the fine particle mixture 6 was used in lieu of the fine particle mixture 1.

Example 7

There was obtained an aqueous dispersion W4 (solid content concentration: 5%) of fine release-agent particles (volume average particle size: 200 nm, melting-point peak temperature: 82° C., onset temperature: 70° C.) basically in the same manner as in the case of Example 1, except that, in the fine particle mixture producing step S2, 100 g of Carnauba wax (manufactured by Toa Kasei Co., Ltd.) was used in lieu of Fischer-Tropsch wax and surfactant and distilled water were put in an amount of 3 g and in an amount of 1898 g, respectively, at the time of preparation of the aqueous dispersion of the fine release-agent particles. There was also obtained a fine particle mixture aqueous dispersion 7 (the ratio of the fine release-agent particles to the fine resin particles: 5% by weight) basically in the same manner as in the case of Example 1, except that 100 g of the aqueous dispersion W4 of the fine release-agent particles 4 was used in lieu of the aqueous dispersion W1 of the fine release-agent particles 1. A fine particle mixture 7 was produced from the fine particle mixture aqueous dispersion 7.

There was obtained a capsule toner of Example 7 (volume average particle size: 7.0 μm, coefficient of variation: 23, dispersion particle size of release agent: 0.1 μm to 0.4 μm) basically in the same manner as in the case of Example 1, except that, in the fine particle mixture adhering step S3, 10.5 parts of the fine particle mixture 7 was used in lieu of the fine particle mixture 1.

Example 8

In this example, the fine particle mixture producing step S2 was not performed, and the fine particle preparing step A2 was performed instead. The aqueous dispersion J1 of the fine resin particles was dehydrated and dried by using Fujisaki Micro Mist Dryer Model MDL-050 (trade name) manufactured by Fujisaki Electric Co., Ltd. thereby to form dried fine resin particles. Similarly, dried fine release-agent particles were produced from the aqueous dispersion W4 of the fine release-agent particles 4.

Neither the fine particle mixture adhering step S3 nor the film-forming step S4 was performed, and the coating step A3 was performed instead in the following procedure.

First, 100 parts of toner base particles and 0.5 parts by weight of the dried fine release-agent particles were put in a surface reforming apparatus equipped with a two-fluid nozzle capable of spraying a liquid into a container (trade name: Hybridizer Model NHS-1, manufactured by Nara Machinery Co., Ltd.) under conditions where retention time was 5 minutes and the number of revolutions was 5000 rpm, so that the fine release-agent particles adhered dispersively to the surfaces of the toner base particles.

Subsequently, 10 parts of the dried fine resin particles were put therein under conditions where additional retention time was 10 minutes and the number of revolutions was 8000 rpm. After that, compressed air was fed to the two-fluid nozzle, and spray treatment using ethanol (special-grade ethanol, manufactured by Kishida Chemical Co., Ltd.) as a spray liquid was carried out for 30 minutes (spraying rate: 0.5 g/min), so that the surfaces of the toner base particles were entirely covered with the fine resin particles and the fine release-agent particles, whereupon a capsule toner was obtained.

The external addition step A4 was performed basically in the same manner as in the case of Example 1. In this way, there was obtained a capsule toner of Example (volume average particle size: 7.0 μm, coefficient of variation: 23, dispersion particle size of release agent: 0.1 μm to 1 μm).

Example 9

There was obtained an aqueous dispersion W5 (solid content concentration: 5%) of fine release-agent particles (volume average particle size: 50 rim, melting-point peak temperature: 82° C., onset temperature: 70° C.) basically in the same manner as in the case of Example 6, except that, in the fine particle mixture producing step S2, surfactant and distilled water were put in an amount of 15 g and in an amount of 1888 g, respectively, at the time of preparation of the aqueous dispersion of the fine release-agent particles.

There was obtained a fine particle mixture aqueous dispersion 9 (the ratio of the fine release-agent particles to the fine resin particles: 5% by weight) basically in the same manner as in the case of Example 1, except that 100 g of the aqueous dispersion W5 of the fine release-agent particles 5 was used in lieu of the aqueous dispersion W1 of the fine release-agent particles 1. A fine particle mixture 9 was produced from the fine particle mixture aqueous dispersion 9.

There was obtained a capsule toner of Example 9 (volume average particle size: 7.0 μm, coefficient of variation: 23, dispersion particle size of release agent: 0.1 μm to 1 μm) basically in the same manner as in the case of Example 1, except that, in the fine particle mixture adhering step S3, 10.5 parts of the fine particle mixture 9 was used in lieu of the fine particle mixture 1.

Example 10

There was obtained an aqueous dispersion W6 (solid content concentration: 5%) of fine release-agent particles 6 (volume average particle size: 100 nm, melting-point peak temperature: 82° C., onset temperature: 70° C.) basically in the same manner as in the case of Example 7, except that, in the fine particle mixture producing step S2, surfactant and distilled water were put in an amount of 6 g and in an amount of 1894 g, respectively, at the time of preparation of the aqueous dispersion of the fine release-agent particles.

There was obtained a fine particle mixture aqueous dispersion 10 (the ratio of the fine release-agent particles to the fine resin particles: 5% by weight) basically in the same manner as in the case of Example 1, except that 100 g of the aqueous dispersion W6 of the fine release-agent particles 6 was used in lieu of the aqueous dispersion W1 of the fine release-agent particles 1. A fine particle mixture 10 was produced from the fine particle mixture aqueous dispersion 10.

There was obtained a capsule toner of Example 10 (volume average particle size: 7.0 μm, coefficient of variation: 23, dispersion particle size of release agent: 0.1 μm to 1 μm) basically in the same manner as in the case of Example 1, except that, in the fine particle mixture adhering step S3, 10.5 parts of the fine particle mixture 10 was used in lieu of the fine particle mixture 1.

Example 11

There was obtained an aqueous dispersion W7 (solid content concentration: 5%) of fine release-agent particles (volume average particle size: 300 nm, melting-point peak temperature: 82° C., onset temperature: 70° C.) basically in the same manner as in the case of Example 6, except that, in the fine particle mixture producing step S2, surfactant and distilled water were put in an amount of 1.5 g and in an amount of 1988 g, respectively, at the time of preparation of the aqueous dispersion of the fine release-agent particles. There was also obtained a fine particle mixture aqueous dispersion 11 (the ratio of the fine release-agent particles to the fine resin particles: 5% by weight) basically in the same manner as in the case of Example 1, except that 100 g of the aqueous dispersion W7 of the fine release-agent particles 7 was used in lieu of the aqueous dispersion W1 of the fine release-agent particles 1. A fine particle mixture 11 was produced from the fine particle mixture aqueous dispersion 11.

There was obtained a capsule toner of Example 11 (volume average particle size: 7.0 μm, coefficient of variation: 23, dispersion particle size of release agent: 0.1 μm to 1 μm) basically in the same manner as in the case of Example 1, except that, in the fine particle mixture adhering step S3, 10.5 parts of the fine particle mixture 11 was used in lieu of the fine particle mixture 1.

Example 12

There was obtained a capsule toner of Example 12 (volume average particle size: 7.0 μm, coefficient of variation: 23, dispersion particle size of release agent: 0.5 μm to 2 μm) basically in the same manner as in the case of Example 7, except that the film-forming step S4 was not performed.

Comparative Example 1

There was obtained a capsule toner of Comparative Example 1 (volume average particle size: 7.0 μm, coefficient of variation: 23) basically in the same manner as in the case of Example 8, except that the dried fine release-agent particles were not used in the coating step A3.

Comparative Example 2

There was obtained a capsule toner of Comparative Example 2 (volume average particle size: 7.0 μm, coefficient of variation: 23) basically in the same manner as in the case of Example 8, except that the dried fine resin particles were not used in the coating step A3.

[Production of Two-Component Developer]

There was produced a two-component developer by mixing each of the capsule toners of Examples 1 to 12 and Comparative Examples 1 and 2 with a ferrite core carrier having a volume average particle size of 45 μm such that the concentration of the capsule toner is adjusted to 7%.

With use of the capsule toners of Examples 1 to 12 and Comparative Examples 1 and 2 or the two-component developers containing the capsule toners of Examples 1 to 12 and Comparative Examples 1 and 2, respectively, thereby obtained, evaluation has been conducted in the following procedure.

[Blocking Resistance]

In a plastic container, 100 g of an external additive-treated toner was hermetically sealed and left standing at 50° C. for 48 hours. After that, the toner was taken out and sifted through a #100-mesh sieve, and the weight of toner remaining on the sieve was measured. The amount of the remaining toner was determined as the proportion to the total amount of the toner. On the basis of the result, blocking resistance evaluation has been conducted in accordance with the following evaluation standard. The smaller the numerical value, the less likely it is that toner blocking occurs; that is, the better the blocking resistance.

Excellent (Very favorable): There is no toner residual.

Good (Favorable): Remaining amount is less than or equal to 5%.

Not bad (No problem in practical use): Remaining amount is greater than 5% but less than 10%.

Poor (No good): Remaining amount is greater than or equal to 10%.

[Fixability and Low-Temperature Fixability]

A two-component developer was charged into a commercially available copying machine (trade name: MX-2300G, manufactured by Sharp Corporation). Then, an image was formed while raising the surface temperature of a heating roller step by step from 130° C. to 220° C. in increments of 5° C. The image was examined in respect of a non-offset range in which neither low-temperature offset phenomenon (a toner image could not be fixed on a recording sheet) nor high-temperature offset phenomenon (a toner image was re-transferred from a heating roller to a white background area of a recording sheet) occurred.

The non-offset range is determined in terms of temperature difference between the lowest fixable temperature and the highest fixable temperature. The lowest fixable temperature is the lowest temperature of the heating roller at which no low-temperature offset phenomenon occurs. The highest fixable temperature is the highest surface temperature of the heating roller at which no high-temperature offset phenomenon occurs.

Fixability evaluation has been conducted in accordance with the following evaluation standard.

Excellent (Very favorable): Non-offset range is 50° C. or above.

Good (Favorable): Non-offset range is equal to 30° C. or above but less than 50° C.

Not bad (No problem in practical use): Non-offset range is equal to 20° C. or above but less than 30° C.

Poor (No good): Non-offset range is less than 20° C.

Low-temperature fixability evaluation has been conducted in accordance with the following evaluation standard.

Good (Favorable): Lowest fixable temperature is less than 155° C.

Not bad (No problem in practical use): Lowest fixable temperature is equal to 155° C. or above but less than 160° C.

Poor (No good): Lowest fixable temperature is higher than or equal to 160° C.

The details on the capsule toners of Examples 1 to 12 and Comparative Examples 1 and 2 are shown in Table 1, and the results of evaluation as to the individual capsule toners are shown in Table 2.

TABLE 1

| | Fine resin particle | | Fine release-agent particle | | | |
|---|---|---|---|---|---|---|
| | Kind | Particle size [nm] | Kind | Particle size [nm] (Proportion to fine resin particle) | Melting point [° C.] | Onset temperature [° C.] |
| Example 1 | Styrene-acryl | 150 | Fischer-Tropsch | 150 (1) | 90 | 82 |
| Example 2 | Styrene-acryl | 150 | Fischer-Tropsch | 300 (2) | 90 | 82 |
| Example 3 | Styrene-acryl | 150 | Fischer-Tropsch | 150 (1) | 90 | 82 |
| Example 4 | Styrene-acryl | 150 | Fischer-Tropsch | 150 (1) | 90 | 82 |
| Example 5 | Styrene-acryl | 150 | Fischer-Tropsch | 150 (1) | 90 | 82 |
| Example 6 | Styrene-acryl | 150 | Polyethylene | 300 (2) | 98 | 70 |
| Example 7 | Styrene-acryl | 150 | Carnauba | 200 (1.3) | 82 | 70 |
| Example 8 | Styrene-acryl | 150 | Carnauba | 200 (1.3) | 82 | 70 |
| Example 9 | Styrene-acryl | 150 | Carnauba | 50 (0.33) | 82 | 70 |
| Example 10 | Styrene-acryl | 150 | Carnauba | 100 (0.67) | 82 | 70 |
| Example 11 | Styrene-acryl | 150 | Carnauba | 300 (2) | 82 | 70 |
| Example 12 | Styrene-acryl | 150 | Carnauba | 200 (1.3) | 82 | 70 |
| Comparative Example 1 | Styrene-acryl | 150 | — | — | — | — |
| Comparative Example 2 | — | — | Carnauba | 200 | 82 | 70 |

| | Amount of addition to 100 parts of toner base particle | | | | |
|---|---|---|---|---|---|
| | Fine particle mixture [part] (Proportion of fine release-agent particle (wt %) to fine resin particle (100%) | Fine resin particle [part] | Fine release-agent particle [part] | Spray liquid | Dispersion particle size of release agent |
| Example 1 | 8.25 (10) | 7.5 | 0.75 | Ethanol | 0.1-0.3 |
| Example 2 | 7.88 (5) | 7.5 | 0.38 | Ethanol | 0.1-0.5 |
| Example 3 | 7.73 (3) | 7.5 | 0.23 | Ethanol | 0.1-0.3 |
| Example 4 | 9 (20) | 7.5 | 1.5 | Ethanol | 0.1-0.3 |
| Example 5 | 9.75 (30) | 7.5 | 2.25 | Ethanol | 0.1-0.3 |
| Example 6 | 8.25 (10) | 7.5 | 0.75 | Ethanol | 0.1-0.5 |
| Example 7 | 10.5 (5) | 10 | 0.5 | Ethanol | 0.1-0.4 |
| Example 8 | — | (10) | (0.5) | Ethanol | 0.1-1 |
| Example 9 | 10.5 (5) | 10 | 0.5 | Ethanol | 0.1-1 |
| Example 10 | 10.5 (5) | 10 | 0.5 | Ethanol | 0.1-1 |
| Example 11 | 10.5 (5) | 10 | 0.5 | Ethanol | 0.1-1 |
| Example 12 | 10.5 (5) | 10 | 0.5 | No spray treatment | 0.5-2 |
| Comparative Example 1 | — | 10 | — | Ethanol | — |
| Comparative Example 2 | — | — | 0.5 | Ethanol | — |

TABLE 2

| | Blocking resistance | | Fixability | | Low-temperature fixability | |
|---|---|---|---|---|---|---|
| | Remaining amount (%) | Evaluation | Non-offset range (° C.) | Evaluation | Lowest fixable temperature | Evaluation |
| Example 1 | 0 | Excellent | 70 | Excellent | 130 | Good |
| Example 2 | 0 | Excellent | 60 | Excellent | 140 | Good |
| Example 3 | 0 | Excellent | 55 | Excellent | 140 | Good |
| Example 4 | 0 | Excellent | 65 | Excellent | 135 | Good |
| Example 5 | 0 | Excellent | 75 | Excellent | 135 | Good |
| Example 6 | 0 | Excellent | 45 | Good | 145 | Good |
| Example 7 | 0 | Excellent | 50 | Excellent | 140 | Good |
| Example 8 | 1.1 | Good | 45 | Good | 140 | Good |
| Example 9 | 0.6 | Good | 40 | Good | 145 | Good |
| Example 10 | 0.5 | Good | 45 | Good | 145 | Good |
| Example 11 | 1.3 | Good | 50 | Excellent | 150 | Good |
| Example 12 | 1.2 | Good | 45 | Good | 140 | Good |
| Comparative Example 1 | 0 | Excellent | 15 | Poor | 150 | Good |
| Comparative Example 2 | 6.2 | Not bad | 70 | Excellent | 130 | Good |

It will be understood from the results listed in Table 2 that the toners of Examples 1 to 12 are excellent in blocking resistance, fixability, and low-temperature fixability, and therefore lend themselves to use for a two-component developer in which both blocking resistance and hot-offset resistance can be achieved at the same time. The toner of Comparative Example 1 is excellent in blocking resistance, but offers poor fixability. Furthermore, the toner of Comparative Example 2 is excellent in fixability, but offers poor blocking resistance.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a capsule toner comprising:

a step of causing toner base particles and a fine particle mixture made of fine resin particles and fine release-agent particles to flow so that the fine particle mixture adheres to surfaces of the toner base particles, thereby forming coated toner particles; and a step of spraying the coated toner particles with a liquid for plasticizing the toner base particles and the fine particle mixture while causing the coated toner particles in the presence of carrier gas to flow so that the fine particle mixture is turned into a film under an impact force, thereby forming a resin coating layer on the surfaces of the toner base particles.

2. The method of manufacturing the capsule toner of claim 1, wherein the fine particle mixture is produced by a method comprising:

a first step of preparing a fine particle mixture aqueous dispersion by mixing an aqueous dispersion containing fine resin particles and an aqueous dispersion containing fine release-agent particles; and a second step of obtaining the fine particle mixture by dehydrating and drying the fine particle mixture aqueous dispersion.

3. The method of manufacturing the capsule toner of claim 2, wherein the aqueous dispersion containing fine resin particles is obtained by subjecting a resin to emulsion polymerization or by emulsifiably dispersing a resin in an aqueous medium.

4. The method of manufacturing the capsule toner of claim 2, wherein the aqueous dispersion containing fine release-agent particles is obtained by emulsifiably dispersing a release agent in an aqueous medium or by substituting an aqueous medium for the release agent emulsifiably dispersed in a solvent.

5. The method of manufacturing the capsule toner of claim 2, wherein, in the first step, the fine particle mixture aqueous dispersion is prepared such that a ratio of the fine release-agent particles to the fine resin particles in terms of weight falls in a range of 3% by weight or more and 30% by weight or less.

6. The method of manufacturing the capsule toner of claim 1, wherein, in the fine particle mixture, a ratio in average particle size of the fine release-agent particles to the fine resin particles falls in a range of 0.3 or more and 2.0 or less.

7. The method of manufacturing the capsule toner of claim 1, wherein an onset temperature of the fine release-agent particles based on differential scanning calorimetry is higher than or equal to 70° C.

8. The method of manufacturing the capsule toner of claim 2, wherein, in the second step, the dehydrating and drying operation is carried out by a heated-air direct drying process.

9. The method of manufacturing the capsule toner of claim 1, wherein a volume average particle size of the fine release-agent particles falls in a range of 0.1 μm or more and 1.0 μm or less.

10. A method of manufacturing a capsule toner comprising:

a step of causing toner base particles and fine release-agent particles to flow so that the fine release-agent particles adhere to surfaces of the toner base particles;

a step of causing the toner base particles to which the fine release-agent particles have adhered and fine resin particles to flow so that the fine resin particles adhere to the surfaces of the toner base particles;

a step of spraying the toner base particles to which the fine release-agent particles have adhered and the fine resin particles which are in a fluidized state, with a liquid having an effect of plasticizing those particles; and a step of turning the fine resin particles and the fine release-agent particles into a film under an impact force, thereby forming a resin coating layer on the surfaces of the toner base particles.

* * * * *